US008733357B2

(12) United States Patent
Sullivan, Jr.

(10) Patent No.: US 8,733,357 B2
(45) Date of Patent: May 27, 2014

(54) COLD WEATHER EXPOSURE MASK

(75) Inventor: John B. Sullivan, Jr., Missoula, MT (US)

(73) Assignee: Talus Outdoor Technologies, LLC, Missoula, MT (US)

( * ) Notice: Subject to any disclaimer, the term of this patent is extended or adjusted under 35 U.S.C. 154(b) by 1316 days.

(21) Appl. No.: 12/520,190

(22) PCT Filed: Dec. 19, 2007

(86) PCT No.: PCT/US2007/088187

§ 371 (c)(1), (2), (4) Date: Jun. 19, 2009

(87) PCT Pub. No.: WO2008/077115

PCT Pub. Date: Jun. 26, 2008

(65) Prior Publication Data

US 2010/0024826 A1 Feb. 4, 2010

Related U.S. Application Data

(60) Provisional application No. 60/870,753, filed on Dec. 19, 2006.

(51) Int. Cl.
*A62B 18/02* (2006.01)

(52) U.S. Cl.
USPC ..... 128/206.22; 128/206.21; 128/206.28

(58) Field of Classification Search
USPC ..... 128/206.12, 206.13, 206.15–17, 128/206.19–206.22; 2/9, 171, 173, 202, 2/203, 206, 207
See application file for complete search history.

(56) References Cited

U.S. PATENT DOCUMENTS

| | | | | | |
|---|---|---|---|---|---|
| 3,014,479 | A | * | 12/1961 | Matheson | 128/206.15 |
| 3,088,459 | A | * | 5/1963 | Rabinoff | 601/166 |
| 3,097,642 | A | * | 7/1963 | Russell | 128/205.17 |
| 3,768,100 | A | | 10/1973 | Colman et al. | |
| 4,095,290 | A | | 6/1978 | O'Brien | |
| 4,641,379 | A | | 2/1987 | Martin | |
| 4,671,268 | A | | 6/1987 | Hunt | |
| 4,764,990 | A | * | 8/1988 | Markert | 2/429 |
| 4,825,474 | A | | 5/1989 | Edwards | |
| 4,941,211 | A | | 7/1990 | Blutstein | |
| 5,575,009 | A | | 11/1996 | Ryvin | |
| 5,704,068 | A | * | 1/1998 | Martin | 2/173 |
| 5,809,572 | A | | 9/1998 | Sisolak | |
| 5,839,432 | A | * | 11/1998 | Daneshvar | 128/201.25 |
| 5,845,340 | A | | 12/1998 | Frislie | |

(Continued)

*Primary Examiner* — Jackie Ho
*Assistant Examiner* — Kathryn E Ditmer
(74) *Attorney, Agent, or Firm* — Katherine Sullivan; Sarah J. Rhoades

(57) ABSTRACT

A Cold or Inclement Weather Exposure Mask is designed to fit snugly around the face, head, and neck. The mask serves vital needs of warmth, humidity, and air flow. A raised, malleable chamber covering the mouth and nose provides a breathing space to allow normal breathing while keeping the face warm and dry. The chamber is affixed to a fabric panel made of a water and wind resistant, non-irritating, comfortable, and stretchable material. A fastening means on the panel holds the mask in place around the wearer. The chamber includes multiple apertures which allow fresh air to pass to the wearer after it is mixed with warm, humid, exhaled air. The apertures also exhaust air and condensation. A raised lip further aids in the removal of condensation. A valve system optionally regulates the flow of air. Colors and pattern selections allow adaptation to all labor and recreation uses.

22 Claims, 23 Drawing Sheets

(56) References Cited

U.S. PATENT DOCUMENTS

| | | | |
|---|---|---|---|
| 5,884,336 | A | 3/1999 | Stout |
| 6,023,787 | A | 2/2000 | French et al. |
| 6,196,221 | B1 | 3/2001 | McCormick |
| 6,272,690 | B1 | 8/2001 | Carey et al. |
| 6,868,852 | B2 | 3/2005 | Gaschke |
| 2005/0155136 | A1 | 7/2005 | Colletti et al. |
| 2006/0085881 | A1 | 4/2006 | Gellis et al. |

* cited by examiner

COLD WEATHER EXPOSURE MASK

CROSS-REFERENCE TO RELATED APPLICATIONS

This patent application claims priority under 35 U.S.C. §119(e) to U.S. Patent Application Ser. No. 60/870,753 entitled "Cold or Inclement Weather Exposure Mask" and filed on Dec. 19, 2006, which application is now pending. The entire disclosure of that provisional patent application is hereby incorporated by reference. This patent application claims priority under 35 U.S.C. §371 to Patent Cooperation Treaty parent application numbered PCT/US 07/88187 filed Dec. 19, 2007.

BACKGROUND

1. Field of Invention

This invention relates to cold weather apparel and more particularly to such face coverings for use in outdoor work or recreation.

2. Description of Related Art

Individuals engaging in inclement weather work and recreation, may be forced to choose between warmth or sufficient oxygen. Obviously, a person must breathe easily in order to allow proper body function. Common solutions have sought to cover the mouth and nose with fabric or complicated tubing and heating systems. However, in cold weather, efforts to stay warm may compromise proper breathing. Breathing cold air is a form of airway trauma that adversely affects the lungs and bronchi leading to asthma and lung injury. Masks and breathing apparatuses have been attempted, but often at the expense of vision, as eye-coverings become fogged by misdirected warm air produced by covered breathing. Weather masks have been used to try to accommodate warmth, proper breathing, and maintain vision.

Prior inventions have sought to improve weather masks, particularly those used in physically exerting activities, but with significant shortcomings. Colman et al. discloses a Cold Weather Face Mask (U.S. Pat. No. 3,768,100) which includes a face piece, separable from a port for vision, separable from an oronasal port, and a tri-furcated chin pocket for folding snugly around the chin Colman et al. attempted to use a malleable nose bridge stiffener in a thick sheet form sandwiched and adjustable to prevent air from escaping to eye wear. As a primary feature, Colman et al. sought to sandwich portions of the mask together using fabric tape. The face piece of the Colman et al. mask engages very closely with the user's face.

U.S. Pat. No. 4,095,290 to O'Brien claims a face mask with eyes, nose and mouth openings. The nose opening is a flap to cover the nose. This invention is little more than a stereotypical ski mask except that it too uses a three-layer sandwiching system: the inner layer is flannel, the thermal barrier is polyurethane, and outer layer is a metalized plastic film. This mask provides no ear or neck protection and the material around the nose and the mouth openings become wet and cold against the skin Martin's Face Mask (U.S. Pat. No. 4,641,379) also employs apertures in direct contact with the skin around the nose and mouth, thus doing nothing to address moisture and condensation. The cone shaped flap which tries to cover the mouth and nose from exposure to the cold air is supposed to incorporate an arch to keep the skirt from resting on the nose. In reality, this provision assists cold air to reach the condensed moisture on the skin, thus causing irritation and chafing.

A Ventilated Face Shield, U.S. Pat. No. 4,764,990 granted to Markert mandates the use of a rigid mask member to separate the air flow of the mouth and nose, thus teaching away from the mixing of air as a potential advantage. Furthermore, the required rigid construction risks injury to the user in physically demanding activities. The Markert mask fails to allow adaptable air exposure. Further, the extent of the prevented direct air flow in this invention may restrict breathing during aerobic activity. The Markert mask does not provide a means to exhaust carbon dioxide which may build up in the mask, thus further restricting breathing in aerobic circumstances. While the breathing region includes an aperture means, it does not provide nether invention provides a design to aid in the transmittal of condensation droplets out of the mask and no way to separate accumulated water and moisture from the skin of the user.

A current Cold Weather Mask on the market (U.S. Pat. No. 4,825,474 to Edwards) claims a mask which requires close contact over the wearer's face. The cloth face member requires seams placed in an undesirable fashion. The nose aperture is not protected from the elements in any way and the nylon-laminate type cloth used in the mask construction is not water resistant; thus, it allows condensation to accumulate and freeze around the user's mouth and nose, causing cold discomfort, chafing, and pain. The Edward mask provides ear apertures for some hearing, but does not keep the ears adequately warm or dry. Further, the Edwards mask does not adequately discourage fogging of eye coverings.

U.S. Pat. No. 5,884,336, granted to Stout seeks to provide weather insulation without inhibiting breathing. The Stout mask calls for a rigid mouth seal that encircles the lips. The nose cover is insulated over the bridge of the nose, but completely open under the ridge. The rigid mouth cover includes a porous hygroscopic material to exchange moisture from orally exhaled and inhaled air. Stout does not contemplate covering the nose to achieve this objective and does not point out a solution to condensation pooling and freezing in the mask. Stout also tries to meet the need of an insulated ear cover, but does so at the expense of supply of sound and comfort.

A number of masks have sought to improve warmth in cold weather circumstances, and they have focused on the need to use hoods or head coverings. A specific example of such a face and head covering is found at U.S. Patent Application 2006/0085881 to Gellis et al. This combination is intended to be used in conjunction with goggles and may be adjusted using VELCRO® brand hook and loop fastener. The mask portion of Gellis et al. touches the user's nose and the fleece fabric acts as a sponge for moisture which allows the freezing moisture to touch the skin Freezing moisture is uncomfortable and unhealthy to skin Gellis et al. provides no means for fog-prevention and actually describes the need to open a flange in order to allow breathability and prevent or reduce fogging caused by condensation created by the face mask and rising into the lens area. The combination is then over-engineered because of a mechanism for converting and stowing the hood in the mask. The bulk created would be uncomfortable and cumbersome for most cold weather uses, which already may require significant layering. The necessity and repetitive disclosure to convert Gellis et al. to a hood and mask teaches away from simplifying breathing and insulation.

McCormick patented a Thermal Exchange Breathing Device (U.S. Pat. No. 6,196,221 B1) with a mechanical heat exchanger module which heats air before it is inhaled by the user. The rigidity required by the McCormick components, as well as those of other prior inventions cause safety concerns for a user recreating. The McCormick mask contemplates direct contact with the face of the user, once again disregarding the problem of condensation and moisture against the skin of the user.

U.S. Pat. No. 6,868,852 B2 to Gaschke discloses a Cold Weather Breathing Apparatus which necessitates the use of a complex channeling system conducting air to the user through the nose and mouth holes. While the Gaschke patent calls for air movement from one orifice to the other, no provision is made to transfer condensed fluids out of the mask, thus moisture build up would be uncomfortable, unhealthy, and cause irritation and chafing.

A need exists for a cold or inclement weather mask that will provide warmth, but not inhibit breathing or other sensory functions of the user and at the same time keep moisture from the face and humidify inhaled air. A mask is needed that will fit snugly and comfortably under a ski helmet or cap and with glasses or goggles without promoting fogging. Where other masks have failed, a mask is needed to prevent skin surrounding the nose and mouth from getting wet, cold, and chafed or chapped. A further need exists for a mask that will not sacrifice safety or movement to provide the desirable objectives.

BRIEF SUMMARY OF THE INVENTION

The present invention presents a new and novel mask designed to turbulently mix inhaled air with warm exhaled air to achieve a balance of temperature and humidity around the face and airway. The face is kept warm and dry while the air around the nose and mouth is humidified. The invention is a cold or inclement weather exposure mask comprising a fabric mounting panel; a thermoplastic, non-rigid, pliable chamber to cover a user's mouth and nose; air intake vent grate in the chamber with optional control valve system; apertures allowing ventilation, exhaust, and moisture disposal from the chamber; comfortable and functional ear covering, VELCRO® brand hook and loop fastener on the fabric panels for tightening mask around the user; and darting or pleating for the snug, dependable fit of the mask. As disclosed and described, the mask has multiple variations and beneficial feature adaptations. The mask achieves important goals, including: 1) providing thermal comfort/warmth to protect the face and airway against cold air exposure; 2) permitting adequate air flow and ventilation for activity; 3) allowing access to senses and faculties; 4) managing moisture to keep the face dry; and, 5) dynamically mixing air to provide a source of humidity to ambient, cold, drier air.

It is an objective of the present invention to provide a mask which has utility to those participating in aerobic or physically exerting activities or work in cold or inclement weather conditions. As a further objective, the present invention seeks to provide a mask which will help to humidify and warm dry, cold air as it enters the mask using the natural mixing of inhaled and exhaled air. Recognizing the delicate balance between breathing warm air and protecting the facial skin and airway from cold, it is an objective of the present invention to allow the face to remain warm and dry. As a further objective tied to outdoor activities, the mask can be worn while sleeping to prevent aspirating water as is common when cold-weather sleepers hide their face inside a cloth or sleeping bag and inhale condensation.

It is an objective of the present invention to fit comfortably under a ski helmet or cap. It is a further objective of the present invention to provide a snug fitting mask contemplated to fit with glasses or goggles. It is still a further objective of the mask to prevent fogging of goggles or glasses.

Another objective of the present invention is to prevent lips and skin surrounding the nose and mouth from getting wet, cold, and chafed or chapped. Cold air coming into contact with the face and upper airways can stimulate asthma, therefore, the present invention has an objective to provide a design which will aid in preventing bronchial constriction associated with breathing cold outdoor air. As a further objective, the present invention seeks to prevent water from becoming frozen on the interior of the mask because of condensation. It is a further objective of the present invention to provide a mask that is easy to disinfect and clean.

Still a further objective seeks to allow the normal talking, breathing, and hearing functions of the wearer. Finally, the present invention seeks to provide options for material types, colors, and patterns for specific application to various uses including but not limited to walking, ATV riding, skiing, hunting, or construction labor.

BRIEF DESCRIPTION OF THE DRAWINGS

The following drawings serve to illustrate the various features and aspects of the invention. These drawings further describe by illustration, the advantages and objects of the present invention. Each drawing is referenced by corresponding figure reference characters within the "DETAILED DESCRIPTION OF THE INVENTION" section to follow.

The invention may be embodied in several forms without departing from its spirit or essential characteristics. The scope of the invention is disclosed below and will be further defined in the claims and in the specific description preceding them. All embodiments that fall within the meaning and range of equivalency of the claims are therefore intended to be embraced by the claims.

DETAILED DESCRIPTION OF THE INVENTION

Figure 4:
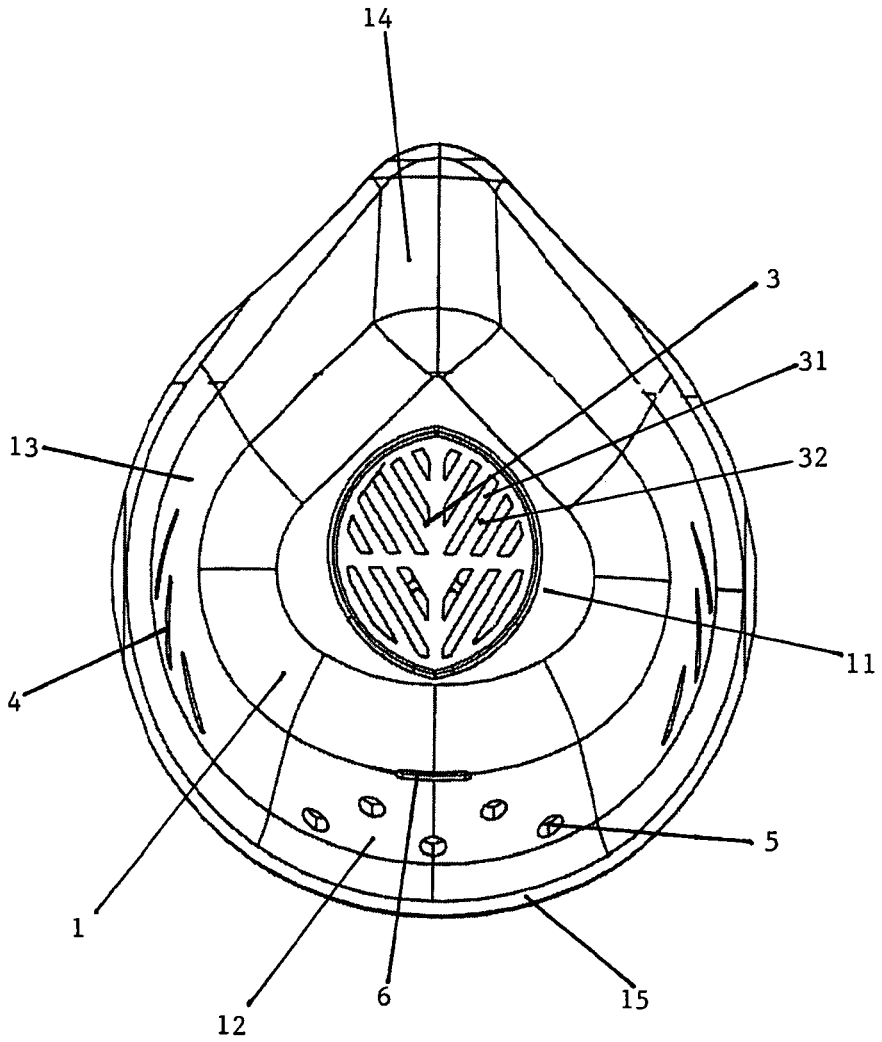
FIG. 4 is a front perspective view of the chamber according to the present invention but separated from any panels.
Figure 7:
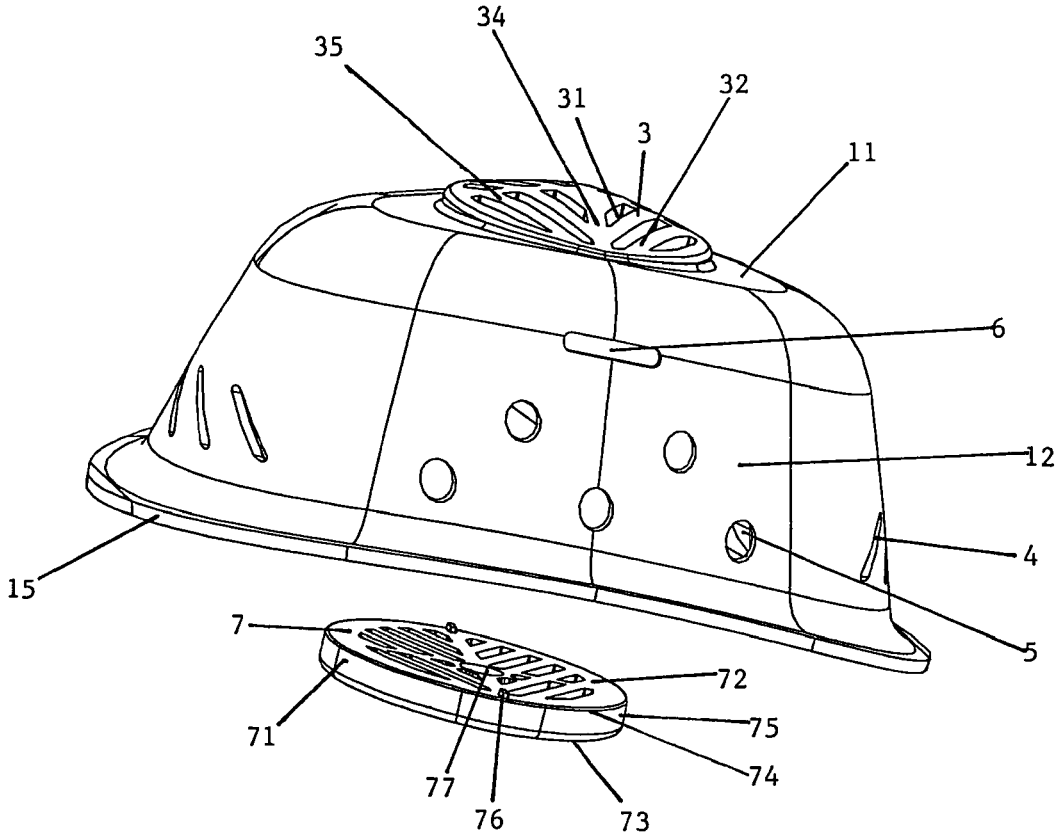
FIG. 7 is bottom, exploded perspective view of the chamber component of the mask according to the present invention, particularly showing the control valve separated from the chamber.

The present invention is a mask incorporating a fabric panel body and a breathing chamber to form a new and improved, non-obvious cold weather mask which will allow the wearer to stay outside and in the elements longer in order to perform work or engage in recreation. As will be appreciated from FIG. 1, the preferred embodiment of the mask comprises a bowl-shaped, concave chamber 1 and a set of fabric panels 2. The chamber extends generally forward to define a breathing space which is fluidly connected to an ambient environment when worn. The chamber of the mask is arranged and constructed to comfortably fit around the mouth and nose of the wearer. The concave chamber has a front wall 11, at least one lower wall 12, at least two side walls 13, and at least one top wall 14, each with an interior surface and an exterior surface. FIG. 4 demonstrates the preferred embodiment which is shown and described as having one front wall, one top wall, one lower wall, and two side walls. The lower wall, the side walls, and the top wall each possess a side that lies adjacent to the front wall. The top wall 14 has a slight medial bend to comfortably form to the bridge of the nose of the wearer. The proximal edge of the chamber walls, except the front wall, rest in a flush manner with the wearer's face due to a continuous peripheral edge 15 disposed on each of the lower wall 12, the side walls 13, and the top wall 14 of the chamber 1. As best shown in FIG. 7, the peripheral edge 15 occurs on these chamber walls in a position opposite of the front wall 11.

In one embodiment of the present invention, the interior surface of the chamber front wall 11 has a pliable short post 17 with a proximal end and a terminal end. The post 17 extends proximally from the chamber and terminates in an enlarged, flat surface 18. The post 17 is illustrated in the rear, exploded, perspective view of FIG. 6. The flat surface 18 and post 17 act as a brad and operates as a receiving means for the control valve 7 component of the present invention, specifically cooperating with the control valve hole 77. The interior wall of the chamber also has at least one depression 16 formed to received at least one cleat 76 on the control valve 7. Desirably, a plurality of depressions 16 which cooperate with a plurality of cleats 76 on the control valve 7 to allow a wearer to select the position of the valve and thus the air flow. These cleats 76 are demonstrated in FIG. 7.

Figure 2:
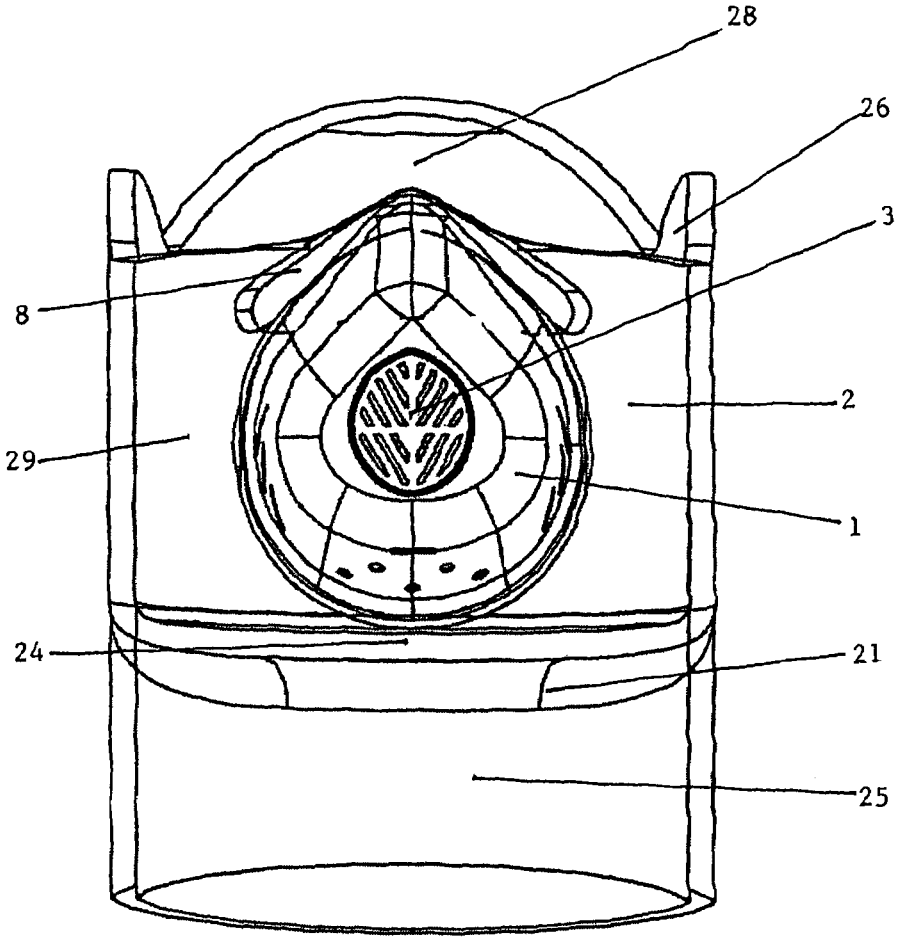
FIG. 2 is a front perspective view of the preferred embodiment according to the present invention.
Figure 3:
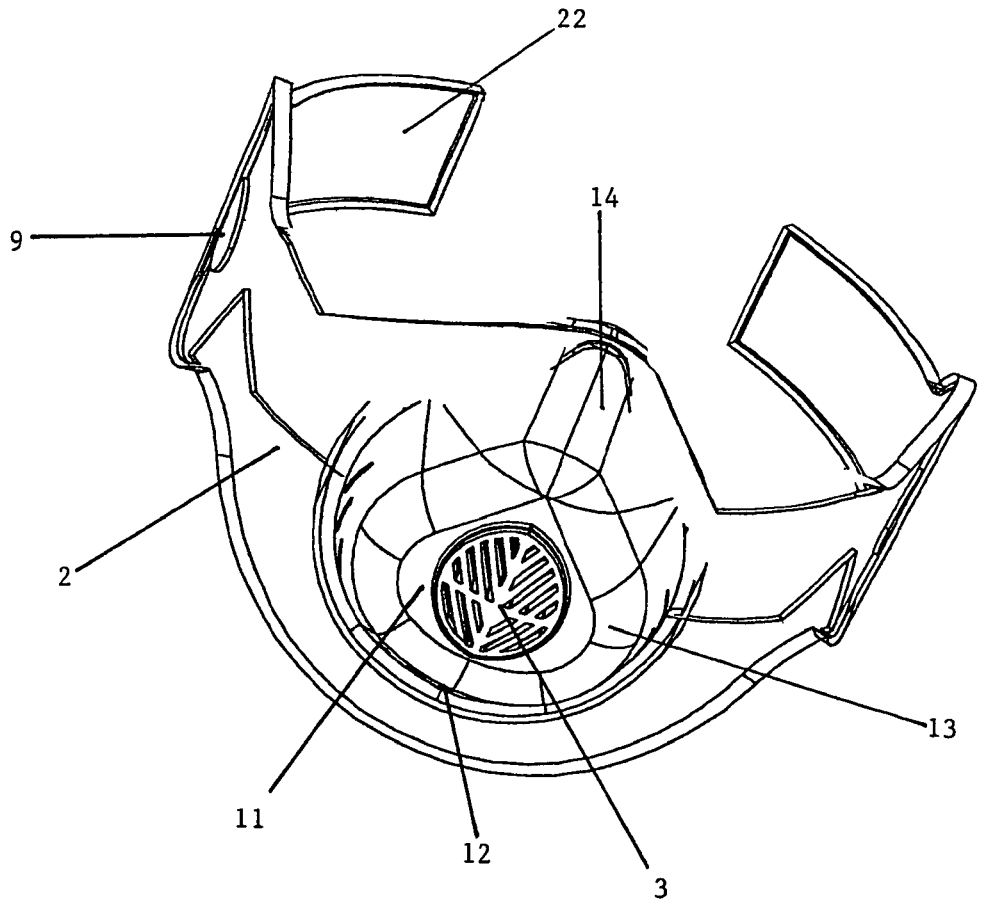
FIG. 3 is a front perspective view of the chamber and the minimum coverage embodiment of the present invention and shows the fabric panels accordingly. One design choice for ear coverage is demonstrated here.

Importantly, the chamber has plurality of apertures including a grate 3 with grate openings 31 between parallel bars 32, passive airflow slits 4, circular voids 5, and at least one slot 6 of the chamber 1. Best shown in FIG. 2, the grate traverses the front wall with grate openings to fluidly connect with ambient air. The preferred setting of grate openings 31 is shown in this figure. These grate openings 31 are bi-directional air flow apertures defining the central air grate of the front wall of the chamber 1. In the preferred embodiment, the grate 3 is centrally disposed on the chamber front wall. The grate 3 is shown in FIG. 3 as being substantially encircled by an ovoid ring 33 having a first bar 34 and a second bar 35 intersecting near the center 37 of the grate 3. The first and second bars are then further intersected by parallel bars. In the preferred embodiment, the first and second bars 34, 35 create four quadrants 36 traversed by parallel bars 32 in angled orientation.

The chamber has at least one slot 6 disposed on the lower wall 12 of the chamber at a distance away from the face and nearer the front wall 11. This slot 6 is critical to the moisture management functionality of the mask. At least one circular void 5 is disposed on the lower wall of the chamber between the slot 6 and the wearer's face. A final set of apertures aid in bi-directional air flow and are called slits 4 and are set at an angle on each side wall 13 of the chamber. In the preferred embodiment there are a plurality of circular voids 5 and angled slits 4. See FIG. 7 for a complete comparison of position, size, and shape of these apertures.

The mask chamber includes an additional important feature to aid in the moisture management system accomplished by the apertures as required in the present invention. This feature is the raised lip 19 of the chamber and is best demonstrated in FIG. 5. The lip 19 is disposed between the lower wall 12 and the peripheral edge 15 of the mask. The lip 19 may also extend to the side walls 13 depending on the specific shape of the chamber. Moisture which travels past the slot 6 and is not dispensed immediately through the circular voids 5 will be trapped, and converge and be redirected back toward the circular voids 5 by the lip 19. This feature is an additional protective mechanism to ensure that any moisture condensing on the chamber does not touch the wearer's skin.

Figure 6:
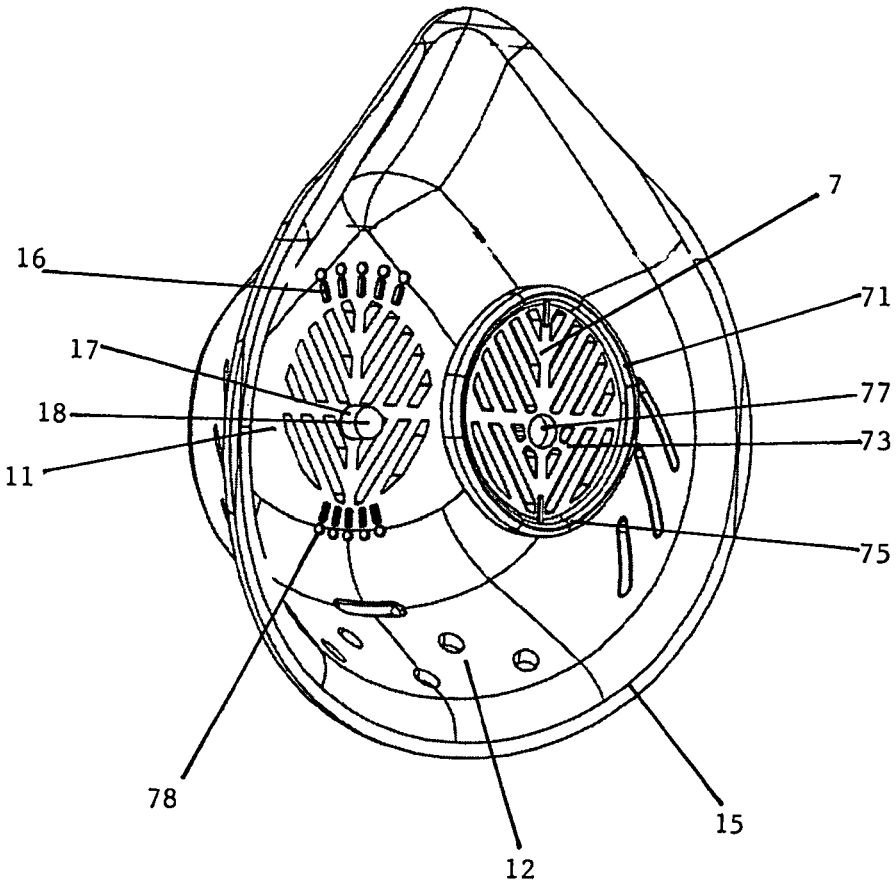
FIG. 6 is a rear, exploded perspective view of the chamber component of the mask according to the present invention, particularly showing the control valve separated from the chamber.

In one embodiment, a control valve 7 is provided to affix on the post 17 and provide air regulation selection. FIGS. 6 and 7 demonstrate a control valve exploded from the chamber. In reality, if the control valve is provided, it is secured to the chamber in any manner consistent with this disclosure. The control valve 7 is substantially flattened member rotatably affixed to the chamber. In the described embodiment the control valve would be affixed to the interior surface of the front wall of the chamber. The control valve could be affixed anywhere on the chamber, interior or exterior and on any wall. In the preferred embodiment, the control valve member is shaped as a disk. The control valve could take on any structure and could have apertures or be a solid structure. In the embodiment shown and described the member is a disk with an outer, ovoid cylindrical structure 71. The cylindrical structure 71 has a distal face 72, a proximal face 73, an interior edge 74 and an exterior edge 75. The control valve has a hole 77 positioned and dimensioned to receive the post 17 extending proximally from the chamber interior wall. After insertion into the hole 77, the flat surface 18 of the post 17 abuts the proximal side of the control valve 7 thereby affixing the control valve 7 to the interior surface of the front wall 11 of the chamber 1 in a manner permitting the control valve 7 to pivot or rotate on the post 17. This feature may also be described as a rotatable dial. The control valve rotate or pivot position is selectable by the alignment of the cleats 76 on the distal face 72 of the control valve disk into the depressions 16 on the interior front wall 11 of the chamber 1.

In the preferred embodiment, the control valve has a number of openings created by a series of structures described herein as vanes 78. The control valve is contemplated to have as few as one vane 78, thus acting as a partial closure mechanism for the apertures. In the embodiment shown and described, the control valve 7 has a plurality of vanes 78 spanning the interior edge 74 of the cylindrical structure 71. In most embodiments, the control valve 7 structure should mirror the structure of the chamber grate 3. As mentioned above, the cleats 76 protrude from the distal face 72 of the control valve 7. These cleats 76 insert into the depressions 16 of the interior surface of the chamber as the alignment of the exploded views of FIGS. 6 and 7 show.

Figure 1:
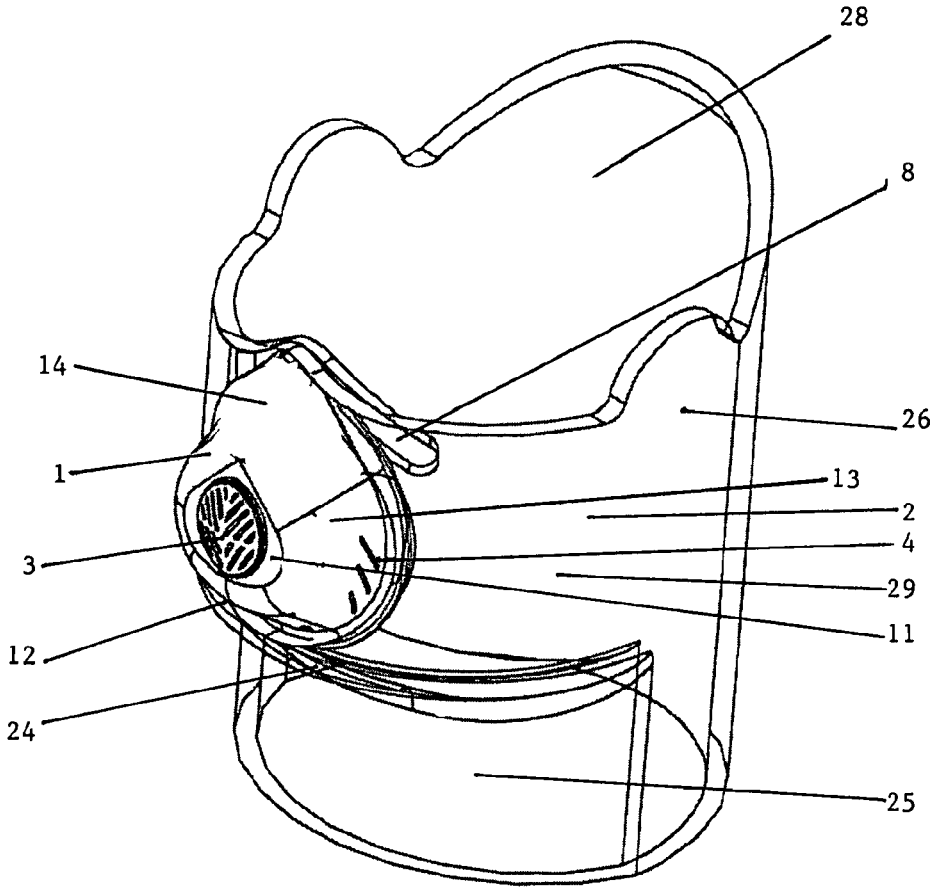
FIG. 1 is a perspective view the moderate coverage, preferred embodiment of the present invention, demonstrating the chamber, nose bridge, and panels.

The body of the mask is provided by a fabric panel 2. The panel 2 may be provided in any convenient manner for manufacture, form, and fashion. At a minimum, at least one panel 2 is affixed to the peripheral edge 15 of the chamber 1 by sewing or other securing means. The chamber could be removably attached to allow for easier cleaning and access to the wearer's nose and mouth. For the preferred embodiment, the panel 2 should be formed and darted and pleated 21 to contour to the chin, neck, ears, and collar of the wearer. In this embodiment, the chamber 1 is centrally located on the panel 2. The chamber 1 could be located anywhere on the panel to accomplish the goals and objectives set out herein. Other embodiments are possible and contemplated within this disclosure. In the preferred embodiment, the panel extends sufficiently to wrap around the head of the wearer. FIGS. 1 and 2 demonstrate the panel as it would appear on a wearer, wrapped and fastened. The panel 2 provides a means to fasten or hold the mask in place on the wearer. For the preferred embodiment, the panel terminates in a fastening means 22 such as cooperating VELCRO® brand hook and loop fastener sections.

The novelty of the present mask is discovered in the flexible, soft, pliable bowl-shaped, concave chamber 1 portion of the mask, called the breathing chamber. The chamber 1 fully covers the wearer's mouth and nose. The chamber is demonstrated in front view, apart from the whole of the mask in FIG. 4. Additionally, the rear view of the chamber in FIG. 5 demonstrates additional features of the chamber and the moisture management system. The wearer is allowed to breathe air because the chamber 1 comprises a space defined away from the wearer's face. Initial ventilation studies indicate that the volume of the chamber 1 allows adequate amounts of air to enter and exit the wearer's mouth and nose in order to meet oxygen demands called for during physically demanding outdoor sports or labor.

The cold weather mask according to the present invention is designed to fit snugly around the face, ears, head and neck of the user. Alternative embodiments are described herein. Selectable sizing means and preferred stretchable materials accomplish a snug fit. The fit is meant to be secure, yet comfortable. Versatility in sizing plus the use of elastic, insulating material for fabric side panels 2 and opposing VELCRO® brand hook and loop fastener straps 22 provide optimum fit.

The specialized shape and contour of the chamber 1 provides an attractive profile as well as critical functionality. The profile of the mask chamber design is not intended to protrude any further than the typical outer goggle plane, or approximately 2-5 centimeters from the wearer's face. Claustrophobic conditions are ameliorated by the constant flow of fresh air into and out of the apertures and the clearance width and depth from the mouth and nose.

In the preferred embodiment, the grate 3 of the mask has a general "V"-shaped pattern for the grate openings 31. Each grate opening 31 occurs in a parallel orientation to other grate openings 31 in the same quadrant 36 of the air intake grate 3. The effect is an aesthetically pleasing "tree" or "leaf"-like pattern. Other orientations such as a common grill design have also been used. The grate openings 31 of the grate 3 are provided for air flow enhancement regulation during forward motion such as skiing or ATV riding. These activities produce an increased air flow, similar to a Venturi effect and decrease the user's feelings of claustrophobia.

Beyond aesthetics, an added benefit of the "V"-shaped orientation is that the orientation helps disperse and mix inhaled air and exhaled air and helps inhibit fog formation on goggles or glasses. Furthermore, the grate 3 is situated so that the grate openings 31 rotate or veer at an angle of approximately ten degrees downward from the top of the vent to the bottom. Thus, aiding the direction of exhaled air downward, away from the goggles or glasses and preventing a direct air blast to the face.

The orientation of the openings in the grate 3 induce turbulent air flow aiding mixing of air—warm and cool, humid and dry, exhaled and inhaled—in the chamber. The effect is an elevation of temperature inside of the mask as demonstrated by studies outdoors at temperatures of 1.1 degrees Celsius and below. Furthermore, the bi-directional characteristics of the openings naturally reduce airflow when air flow demand is reduced such as when sitting, riding a lift, or sleeping. In these situations, increased air flow is not desirable or needed.

The passive airflow slits 4, circular voids 5, and the moisture management slot 6 each provide a primary point of exit for air taken in through the central air intake grate 3 as well as that exhaled by the wearer. The functionality of the apertures are derivatives of their location and size. The circular voids 5 and moisture management slot 6 occur in a downward direction from the grate 3. Due to natural laws of gravity and direction of exhaled breath, accumulated moisture and exhaled air will tend to escape from the ports placed downward of the grate. In the preferred embodiment, the grate 3 is coordinated with one moisture management slot 6 in the lower wall 12, a good distance from the wearer and nearer the front wall 11. This slot 6 is approximately 2.5 centimeters from the wearer's face and in most circumstances is the only location that will discharge condensation gathered from the chamber 1. Current tests show that condensation will begin draining from the moisture management slot 6 after about 2 hours of use in highly active conditions such as alpine skiing and only after approximately 4 hours will the moisture move to the circular voids 5. Finally, in the preferred embodiment, circular voids 5 occur in sets of three or more. The voids 5 are shown from a bottom view in FIG. 7. Alternative embodiments would allow the voids 5 to be in any shape and in any number. As shown in FIG. 7, the circular voids 5, are located in the lower wall 12 of the chamber, at approximate intervals of 0.3 to 2 centimeters from the wearer's face. The coordination of the central air intake grate 3, the circular voids 5 and moisture management slot 6 create a turbulent air flow which allows for air mixing and fresh air exchange. The passive air flow slits 4 permit added bi-directional air exchange and evaporation.

Recognizing the delicate balance between breathing warm air and protecting the facial skin and airway from cold, the present invention allows the face to remain warm and dry. This function is further enhanced by the warming of inhaled air, by keeping the moisture away from the skin, and by venting carbon dioxide whether the wearer is exercising or resting. An example of resting when the mask would be beneficial would be in a camping or backpacking scenario where one is trying to rest or sleep outside in cold or inclement weather. Proper air exchange in such circumstances can aid sleeping and reduce apnea because fresh air is constantly available.

The present invention requires no mechanization to warm the air captured by the air intake vent 3, instead warming of the air occurs dynamically from mixing warmed exhaled air with inhaled air. Fresh air is warmed in the chamber 1 before it is breathed by the wearer, because it mixes with immediately exhaled air traveling to and from the grate. This mixing of air also permits the incoming air to gain a comfortable humidity quotient as demonstrated by studies. Outside temperature compared to inside mask temperature variances are comfort-controlled by the air intake grate 3. Initial temperature tests indicate a four to sixteen degree (Celsius) differential between ambient air and air inside the chamber 1, e.g. one study showed an approximate temperature of 22 degrees Celsius inside the mask when outside temperatures were approximately minus five (−5) degrees Celsius.

The formation and features of the chamber 1 allow performance of the desired objectives because the wearer is provided warm, moist air directly to the mouth while air can be exhaled without interruption thus keeping moisture from the face. The provision of continuous bi-directional air flow exchanges removes all the stagnant exhaled air from the chamber 1 to desirably provide air that is rich with oxygen to supply working muscles.

The air intake vent 3 may have a control valve 7. FIGS. 1-2 illustrate the preferred embodiment for the control valve 7 system. The rotatable dial formed by the cooperation of the control valve 7 and the post 17 permits air control. The control valve 7 and chamber 1 further utilize locking means to hold the control valve at the desired position or station. The demonstrated embodiment calls for a depression 16 and cleat 76, but a notch and bump, or dimple and dome, or similar designs that may manipulate the partial closure of the apertures of the central air intake grate 3 could be used. A simple lever could be used for the control valve 7, but preferably of a type made of soft, pliable material. Optional indicator dots 78, shown in FIG. 6, provide a differentiating means for a position of relative open or closure, called stations. According to this design, a final stop location may be included for the rotatable dial in order to prevent full rotation of 360 degrees. The preferred embodiment uses 5 stations of use, however, use of 6 or 7 stations, or alternatively, entire rotation could used. Other variations will be obvious to one skilled in the art and are incorporated into this disclosure.

The control valve 7 allows the wearer to reduce the volume of incoming air. The reduction in incoming air allows an increase in temperature of air intake as described above. This is the selectable quantity adjustment for the air intake of the present invention. In one embodiment, the interior valve allows the wearer to have maximum airflow or to reduce the airflow in stages to approximately 67% of the maximal air flow as demonstrated by anemometry. Even when airflow is reduced, adequate air exchange is still realized as demonstrated by ventilation studies. The valve accessory post 17 attaches the control valve 7 for rotational or pivot setting air flow options. The center valve accessory post 17 also can be an attachment point for various filters instead of or in combination with the control valve 7. Filters, or restrictive sponges, may provide benefits to wearers who have special conditions such as asthma or need excess particulates, dust, or humidity filtered from ambient air. A test with an air flow anemometer has demonstrated adequate capability of the design to allow entry of air while ventilation studies demonstrated that oxygen and carbon dioxide were maintained in normal ranges for health. Similar tests confirm favorable temperature and humidity gradients.

The present invention presents a new and novel way of managing moisture that forms as a result of warm exhaled air touching the interior surface of a mask abutting cold ambient temperatures. No prior mask has successfully dealt with this problem which can cause chapping and chafing of the wearer's skin. The present invention's moisture management system works because it comprises four key design concepts. The first of these design concepts involves the chemistry of the chamber. The moist air exhaled is attracted by hydrogen bonding to the interior surfaces of the chamber. The use of passive air flow voids 5 and moisture management slot 6 allow an escape means for moisture that has bonded to the mask. The moisture management slot 6 is located near the front wall of the chamber just below the grate where a draining, "gutter" effect is created. To further direct direction of the flow of moisture, a textured inner surface helps moisture accumulate courtesy of the magnified surface area for hydrogen bonding and then escape through the apertures. The moisture management slot 6 is spaced away from the wearer's face. In the preferred embodiment, the apertures occur on the lower wall in another "V"-shaped pattern. The moisture simply drains downward due to gravity and exits at a clear distance from the wearer's skin. The passive air flow voids 5 and moisture management slot 6 allow both drainage of moisture and passive airflow.

A key aspect of the moisture management system comes from an added benefit of the moisture management slot 6. Upon exhalation, the mask is designed to force moisture and air out of the moisture management slot 6 and passive airflow voids 5 as air is forced through the intake grate 3 and some air is deflected downward. The bottom and side vents also work for inhalation during times having high intake or exhale demands. The additional apertures give a more direct air exchange as may be desirable for outdoor sports or labor. The moisture management system is further aided by the raised lip 19 of the chamber which helps keep the moisture away from the chin area of the face. These features are vital to maintaining a dry face during activity or even when inactive.

In the preferred embodiment, the chamber 1 and the fabric lining surrounding the chamber will rest at the bridge of the wearer's nose. In an aspect of a further embodiment, the use of a malleable material may supply a bridge 8 shaped to fit the wearer's nose. Such a malleable material for the bridge 8 may include rubber foam, spring steel, aluminum, plastic, metal, or other suitable material. Ideally, the bridge 8 is designed into the chamber 1 or panel 2 at the nose area and allows the wearer to mold the nose area to their particular facial features.

Figure 5:
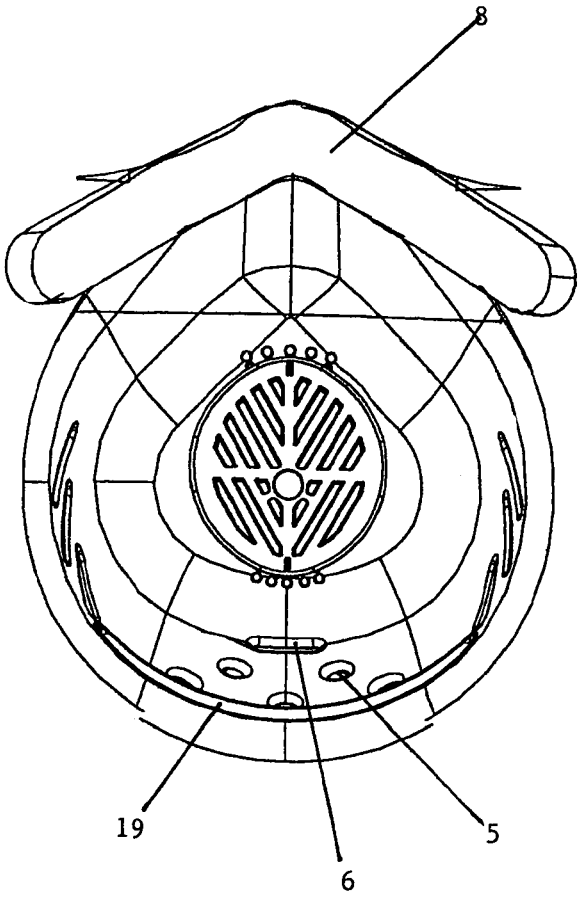
FIG. 5 is a rear view of the chamber according to the present invention.

Desirably, the bridge 8 is hidden from view within the fabric of the panel 2 or chamber 1 of the mask. However, FIGS. 1 and 2 demonstrate a bridge 8 as though it would be visible. FIG. 5 demonstrates the bridge 8 from the rear of the chamber 1. The bridge design will rest comfortably under and work in conjunction with ski goggles to prevent fogging. This adaptation will hold the mask in place and provide even further fogging inhibition. Excess air is inhibited from escaping up into the eye-wear area. As a further advantage of this adaptation, eyeglasses may also rest comfortably on the bridge 8 or other adaptation on the top wall 14 of the chamber. An important benefit of the present invention is that the design specifically prevents fogging of eye-wear thereby maintaining acceptable vision. The design further requires crash soft, or injury preventative characteristics which will prevent injury to the nose in case of direct trauma.

The chamber 1 must be made of pliable or flexible material such as thermoplastic, rubber polycarbonate, polyurethane, foam, plastic, or other resin. This critical feature of the present mask allows it to be crash soft. In other words, in case of a collision or wreck, the wearer decreases his chance of injury to his face because of the flexible thermoplastic and non-rigid design by absorbing trauma injury and not transmitting this energy to the face. The mask is contemplated to be produced by injection mold or other suitable means. The valve accessory post 17 and control valve 7 may or may not be molded on ski mask for a simpler and cheaper mask design. In such variations, the mask would not have selectable air intake, but only one air flow setting such as is visible in FIGS. 1, 2 and 4. Alternatively the control valve 7 may be molded separately for later assembly. Such assembly is demonstrated in FIG. 5.

The use of thermoplastics makes the mask extremely malleable, thus, the moisture management system orifices may be easily stretched to allow the insertion of oxygen flow from a tank in rescue operations or for water, hydration, or feeding tubes. Upon removal of such apparatuses, the thermoplastic material will immediately return to its initial configuration. Although not intended to replace emergency oxygen masks, this aspect of the invention may prove useful in high altitudes, in emergency search and rescue missions, for ski patrol, or simply for hydration during all-day activity.

The chamber is secured to at least one fabric panel 2 for mounting on the wearer's face. The material used for these panels must not irritate the skin in cold weather conditions and preferably provides additional insulation function. The panels may cover only the cheeks, chin, and ears; cover only the cheeks, chin, neck, ears, and base of the head or back of the neck; or cover all of these features and the crown of the head. Other variations will be obvious to one skilled in the art and such variations are incorporated herein. Examples of fabric which may be used include POLARTEC® brand fabric, water and wind resistant material such as fleece or other fabric, flannel, nylon, or other insulating material. Any of these materials may have characteristics of GORE-TEX® brand or other treatments or advances in cold weather materials or fabrics.

The fabric may be cut in various formations to succeed in covering the wearer's face, neck, ears, or head. Currently, three embodiments exist: minimum coverage, moderate coverage, and maximum coverage. The first embodiment, the minimum coverage design covers the face with the chamber and has minimal panels which only cover a portion of the face, such as the cheek 29, chin 24, and possibly the ears 26. The first embodiment may be secured in any fashion disclosed herein but is particularly adaptable for fastening in a headband-like fashion. FIG. 3 shows a minimum coverage embodiment of the present invention. A portion of the panels have been cut away, but could also represent a terminating portion of the fabric panels 2 such as may be desired for a tension securing mechanism. Panels may secure the mask in a number of way including: memory materials, resistance or elastic headband, or a bikini-type or harness-type strap around the head which may terminate in VELCRO® brand hook and loop fastener.

The second, and preferred, embodiment is the moderate coverage design. See FIGS. 1 and 2. The moderate coverage embodiment is darted or pleated 21 around the cheek 29, chin 24, neck 25, ears 26, and back of head and neck 28 in order to provide an aesthetically pleasing, conforming profile which optimizes wind resistance and insulation. The combination of darting, pleating and stretch material is optimal. The mask's tailored design aids its snug and comfortable fit. Because the mask covers the nose and mouth, this feature is essential. The tailored fit may encourage and aid ongoing participation in physically demanding activities. This feature is critical to the wearer's safety because all of the wearer's senses and faculties remain fully accessible. The tailored fit also allows the mask unique applications to camping where warm air intake and cold weather protection is important. The design also allows a camper to have his head outside a sleeping bag to prevent excess moisture from being trapped in the bag thus causing moisture in the bag's interior and the sleeping camper's lungs. The fabric panels 2 of this embodiment may come around the back of head 28 and extend down to cover full neck area 25. The moderate coverage embodiment allows more clearance for helmets and additional fit, comfort, and warmth.

Figure 8:
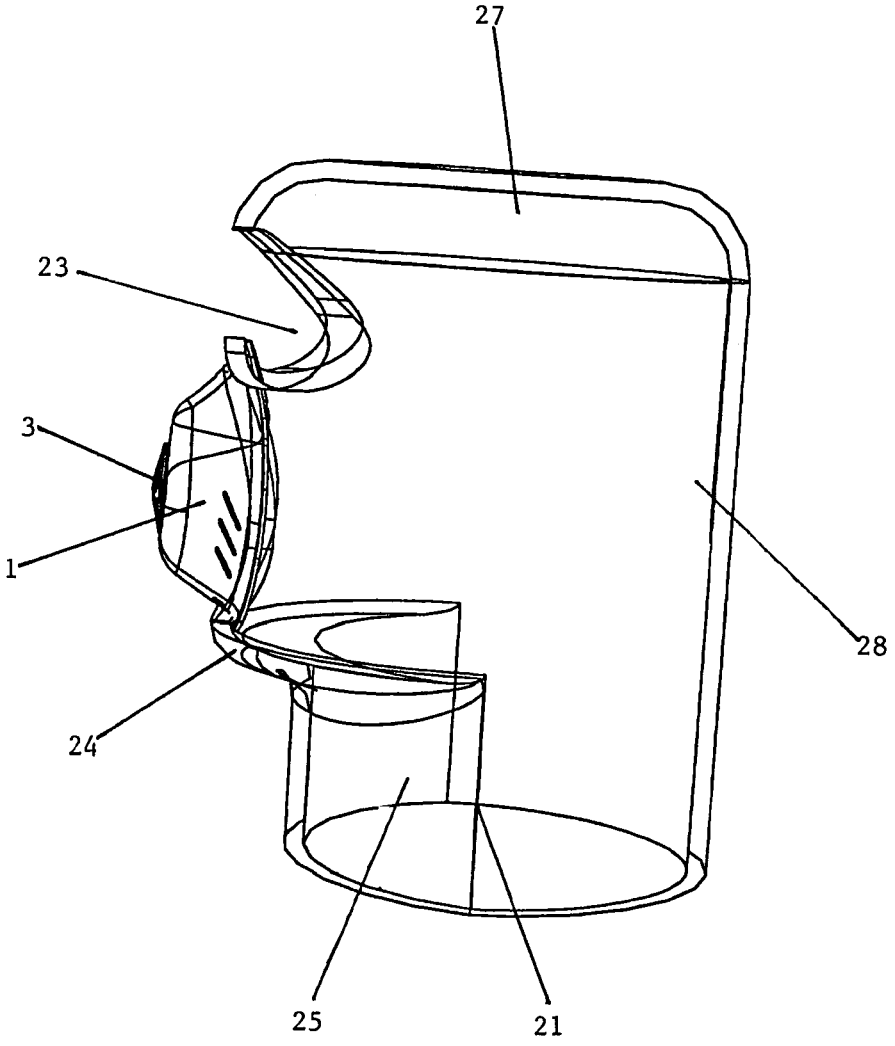
FIG. 8 is a side, perspective view of the maximum coverage embodiment of the mask according to the present invention.
Figure 9:
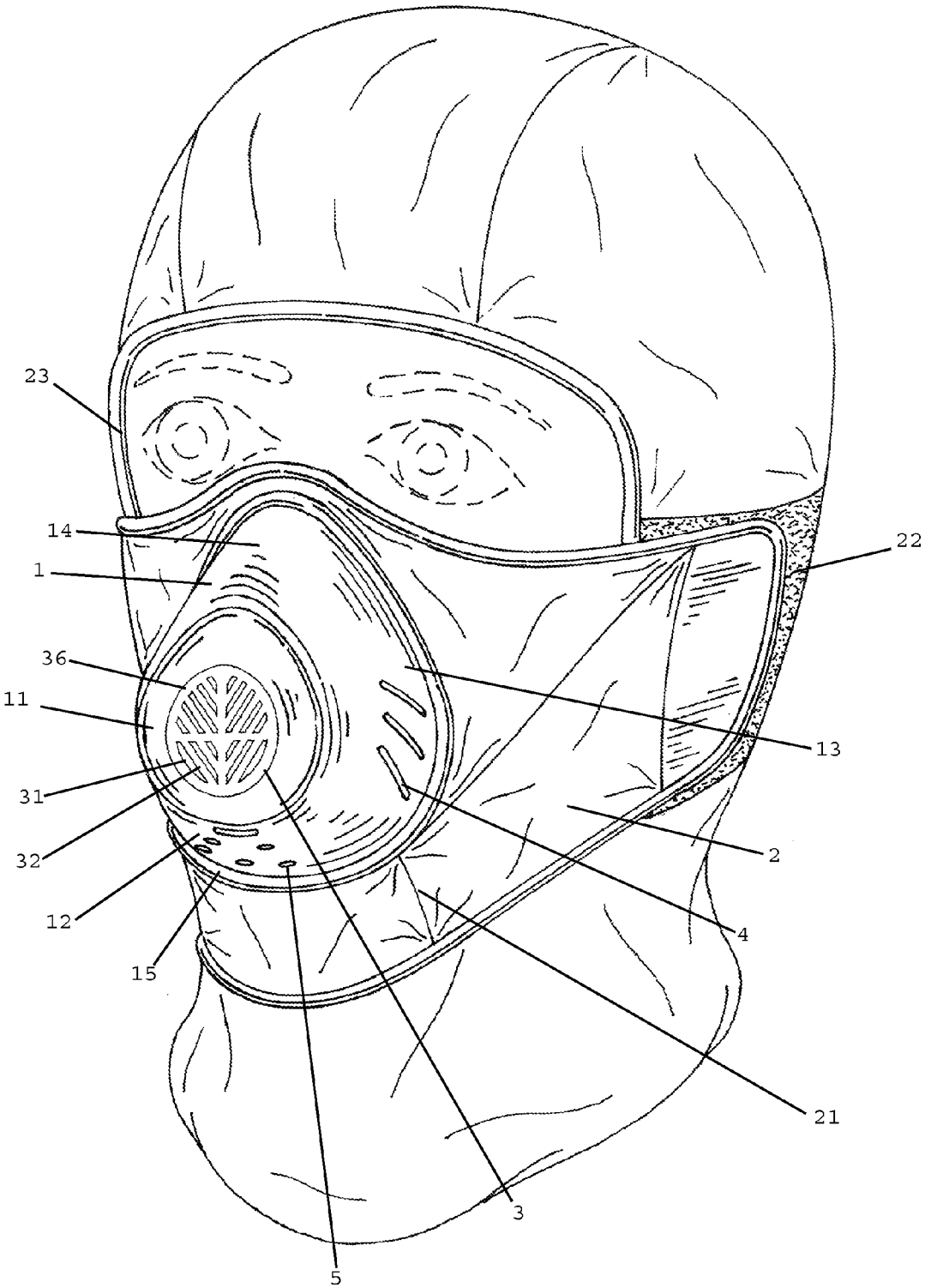
FIG. 9 is a perspective view of the maximum coverage embodiment of the mask worn by a human according to the present invention.
Figure 10:
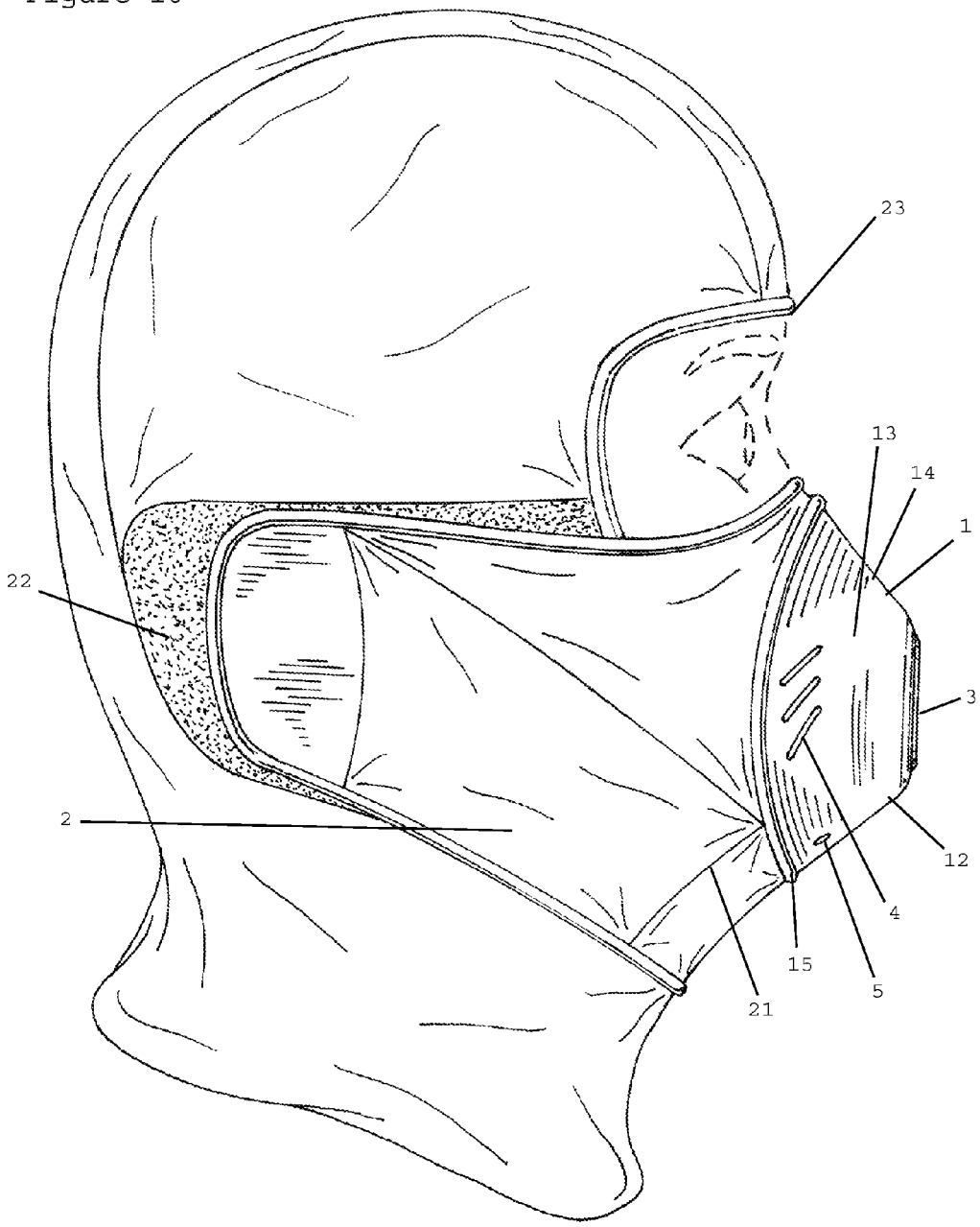
FIG. 10 is a right side view of the maximum coverage embodiment of the mask according to the present invention.
Figure 11:
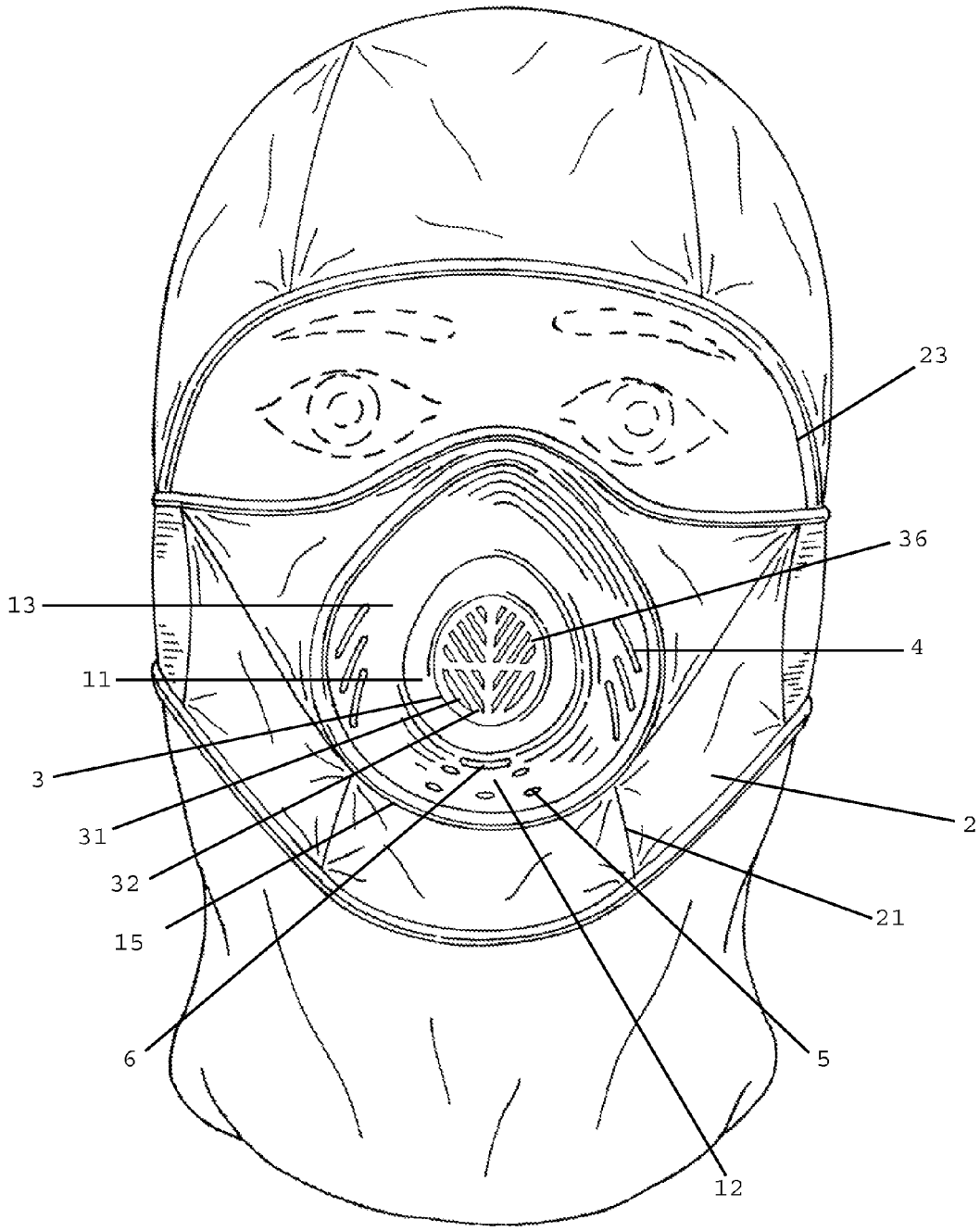
FIG. 11 is a front view of the maximum coverage embodiment of the mask according to the present invention.
Figure 12:
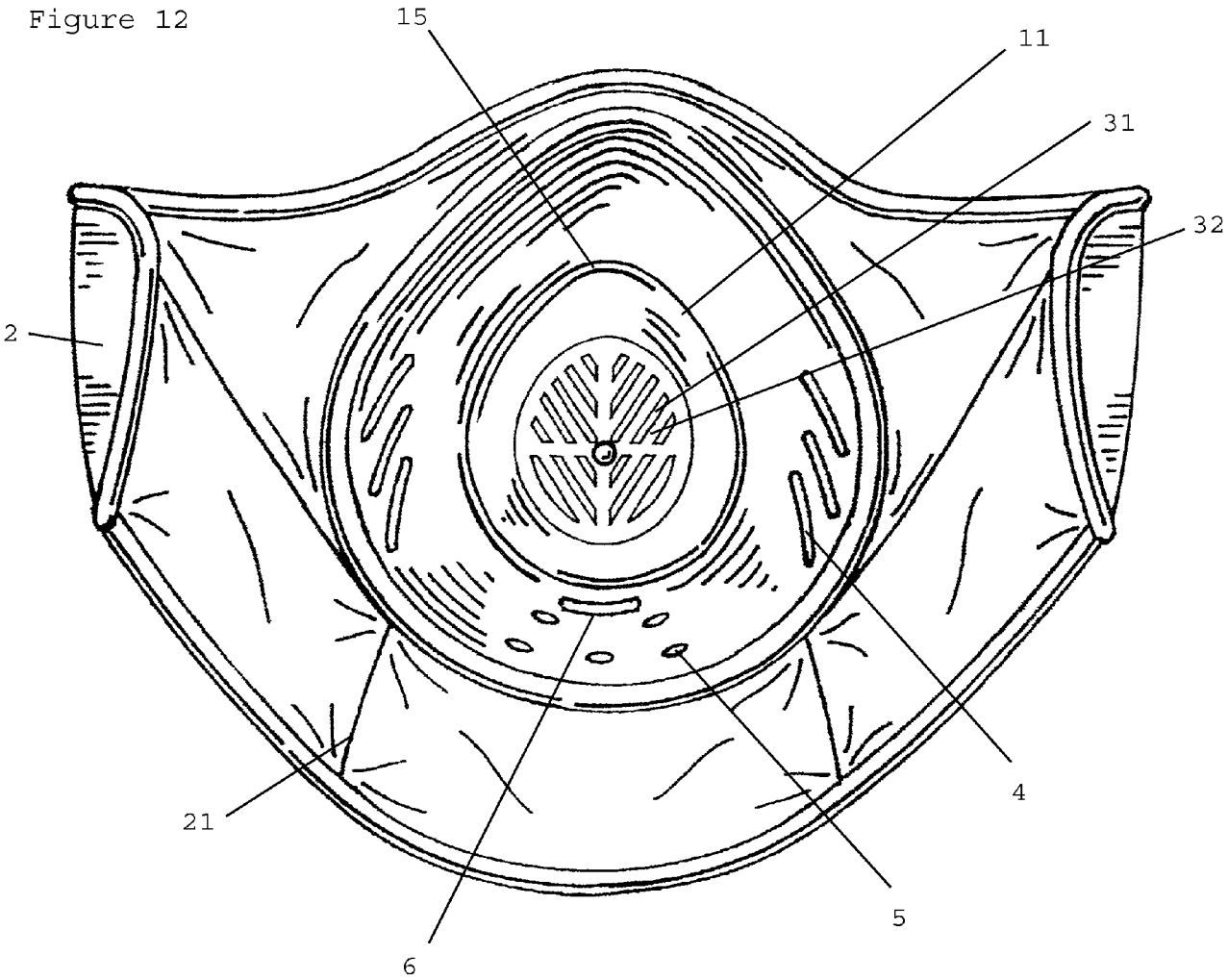
FIG. 12 is a rear view of the face mask portion of the embodiment first shown in FIG. 10 as it appears when detached from the maximum coverage balaclava shown in the previous views.
Figure 13:
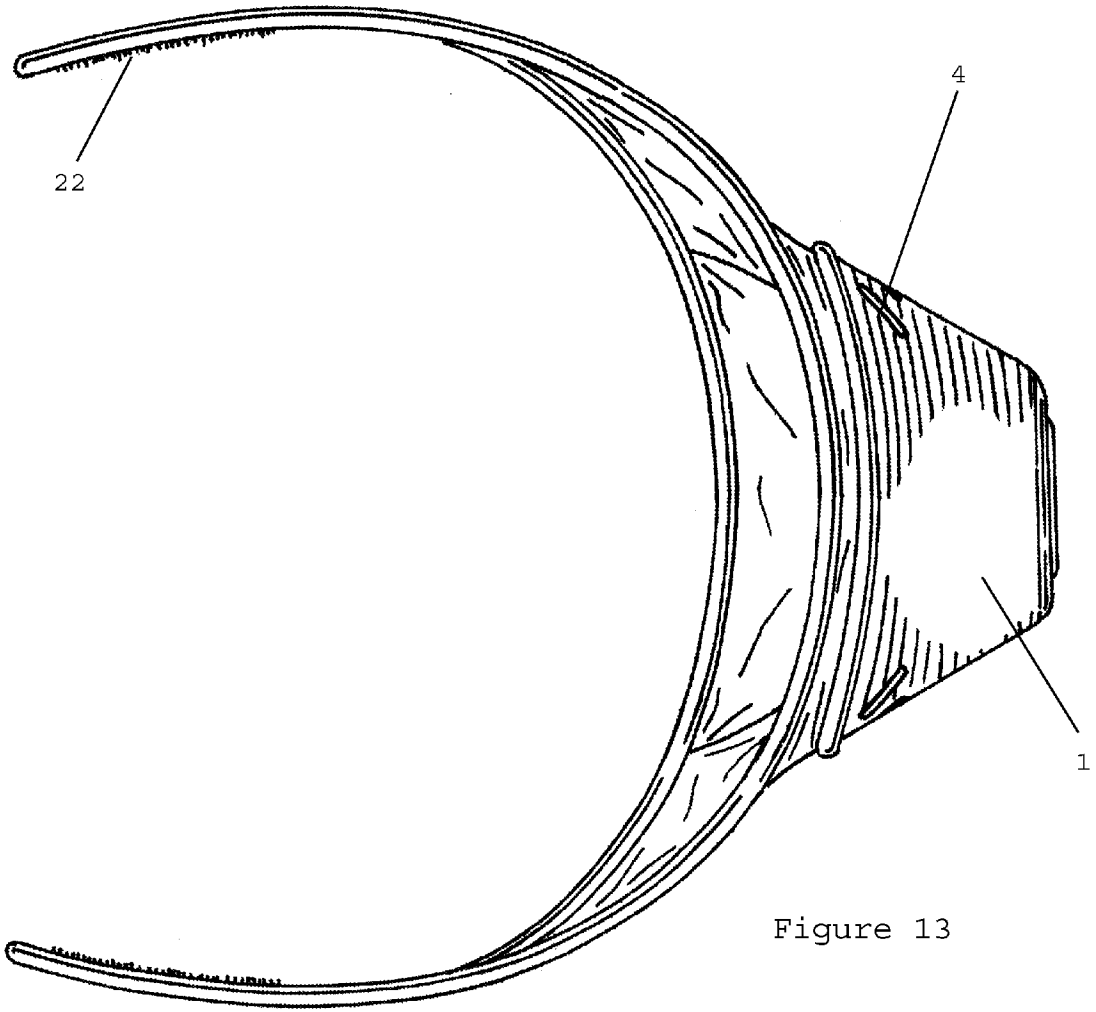
FIG. 13 is a top view of the face mask as shown in FIG. 12.
Figure 14:
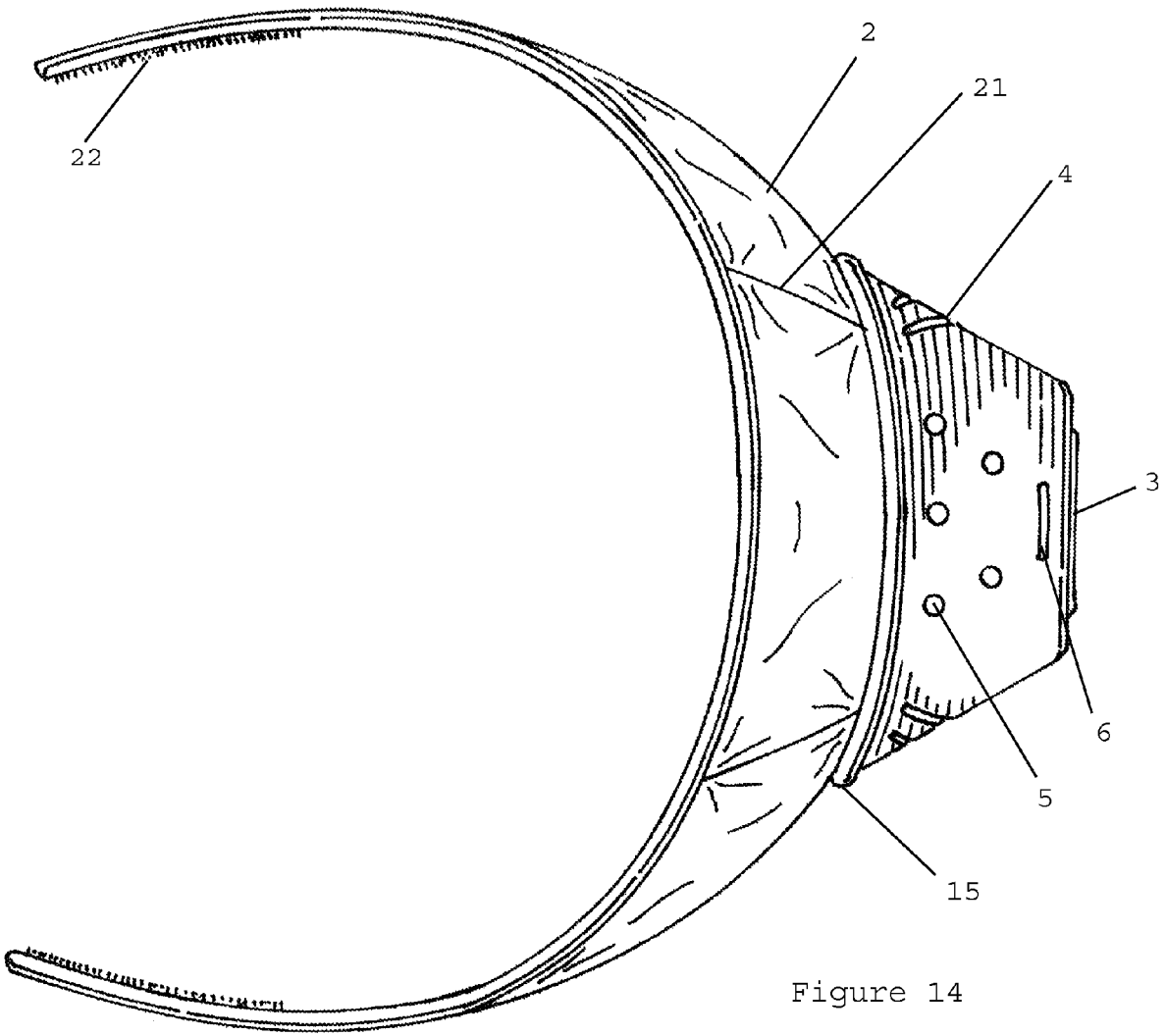
FIG. 14 is a bottom view of the face mask as shown in FIG. 12.
Figure 15:
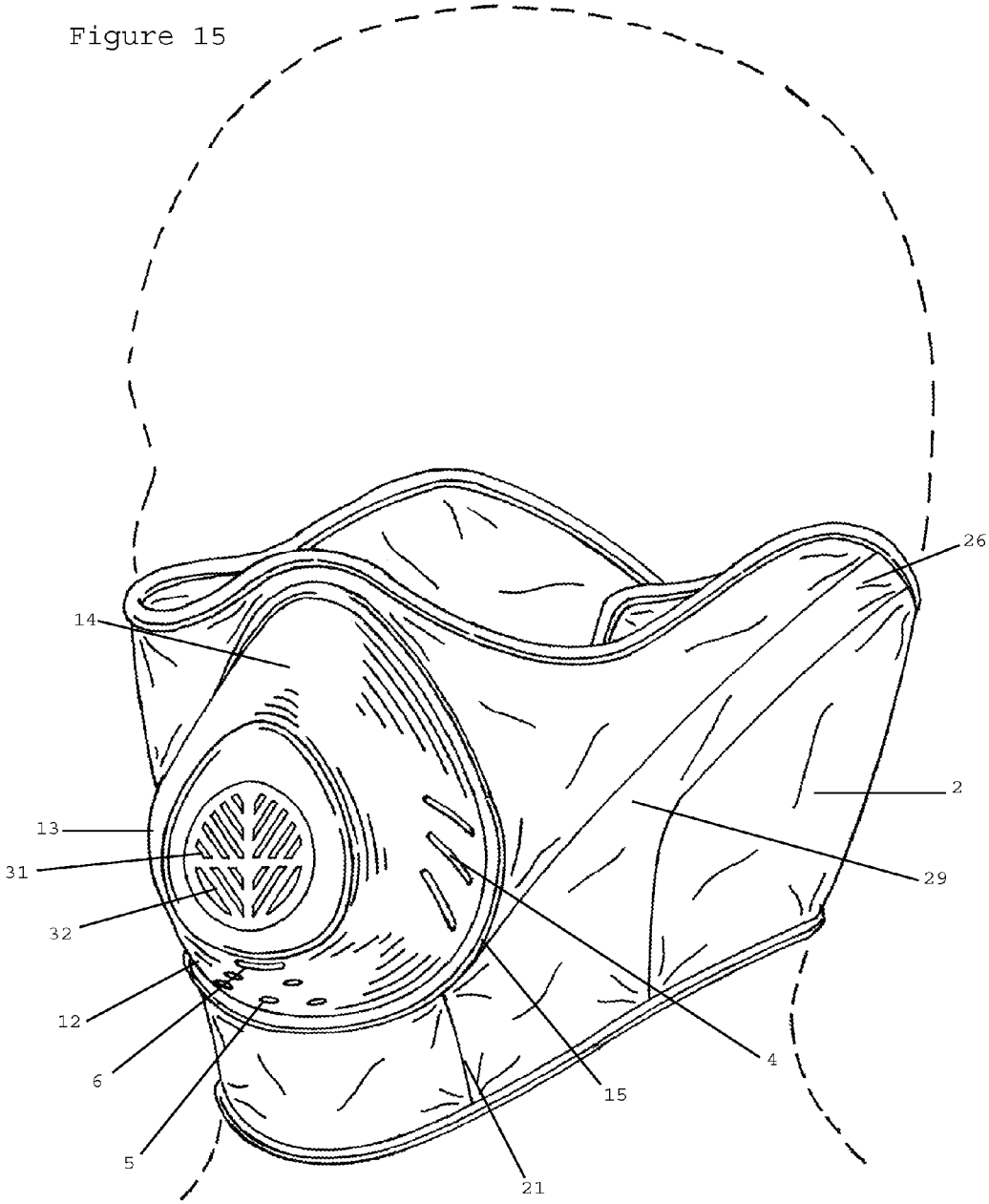
FIG. 15 is a front perspective view of the preferred embodiment of the present invention as it would be worn by a human.
Figure 16:
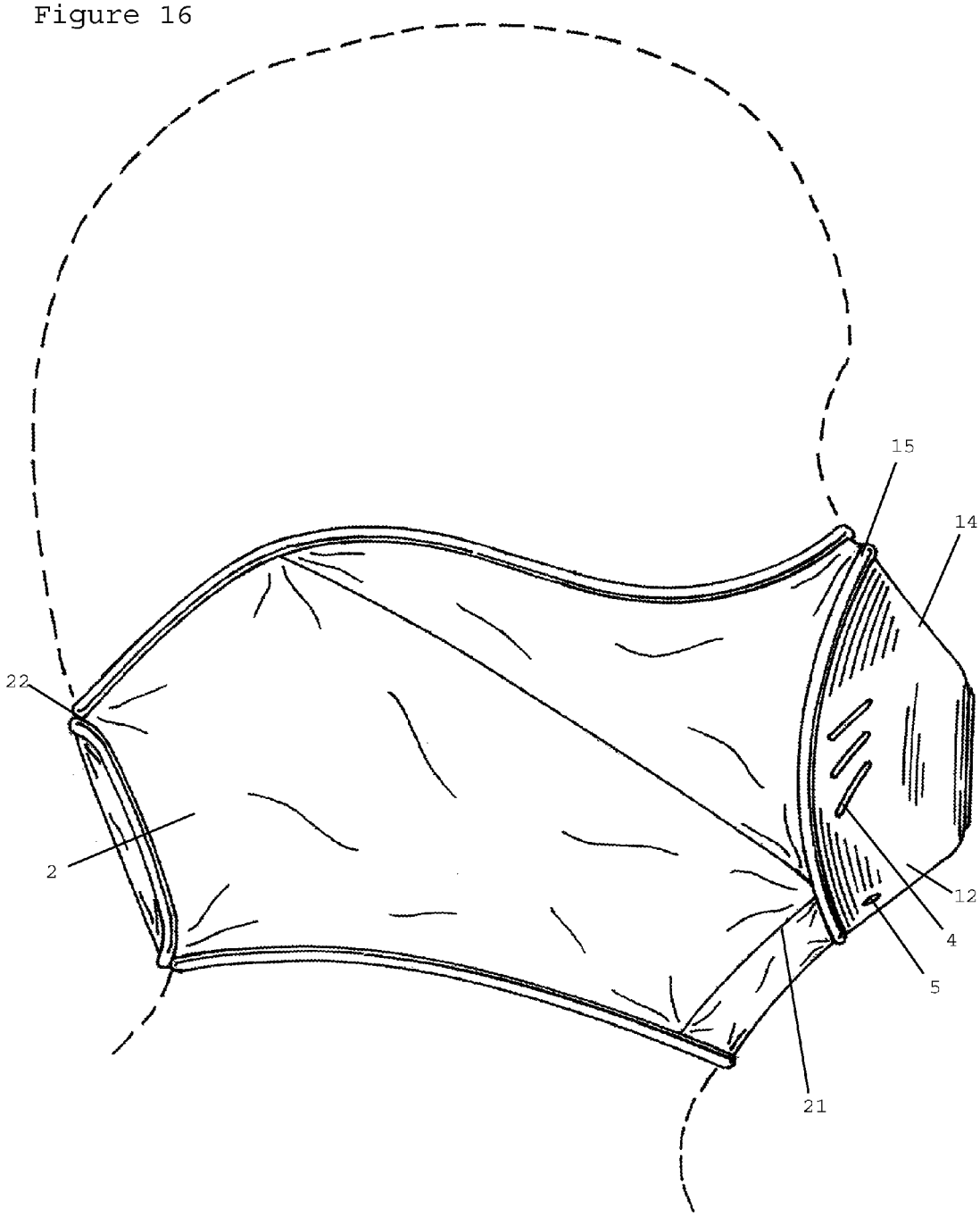
FIG. 16 is a right side view of the preferred embodiment of the present invention as it would be worn by a human.
Figure 17:
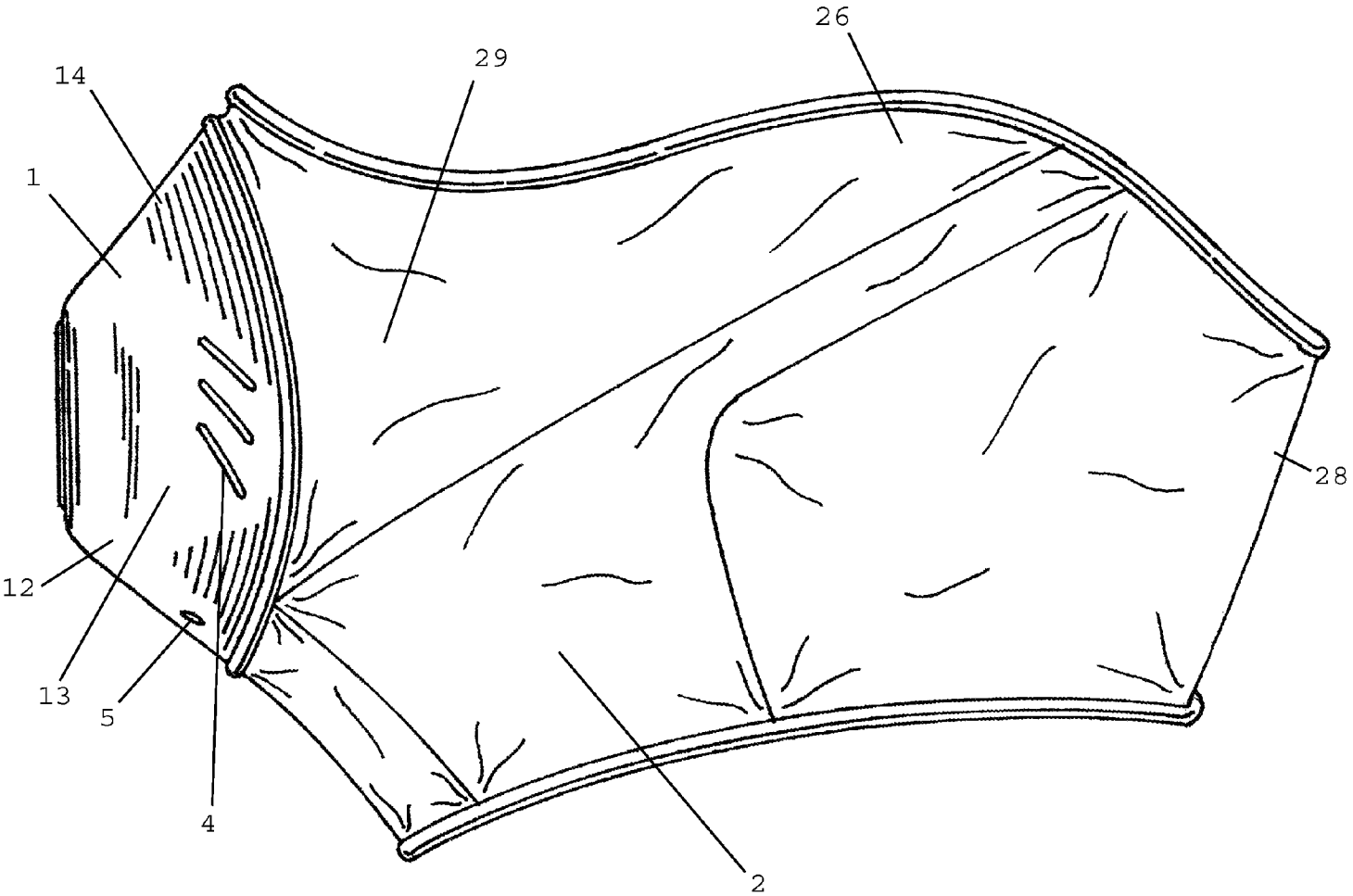
FIG. 17 is a left side view of the preferred embodiment of the present invention.
Figure 18:
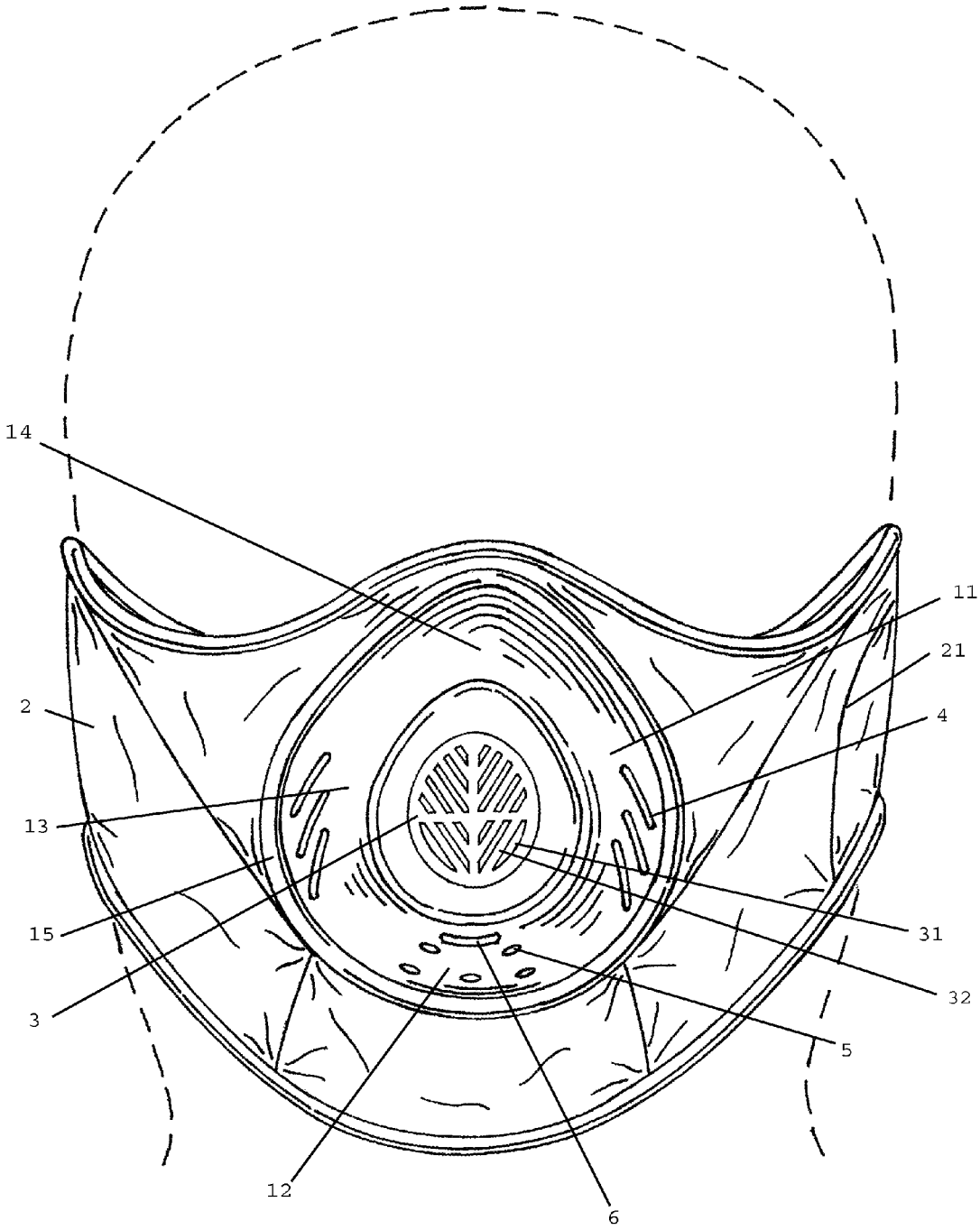
FIG. 18 is a front view of the preferred embodiment of the present invention.
Figure 19:
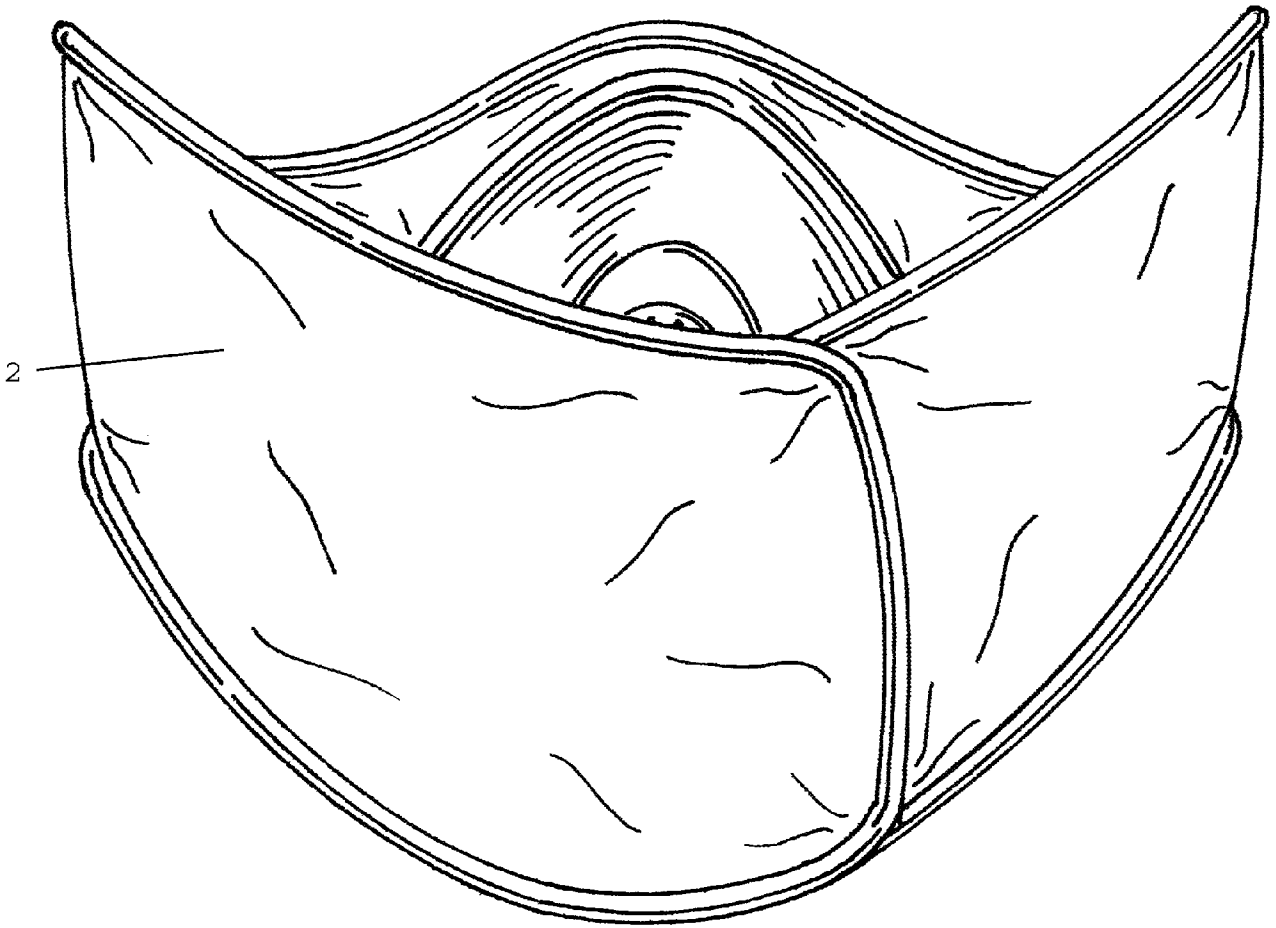
FIG. 19 is a rear view of the preferred embodiment of the present invention.
Figure 20:
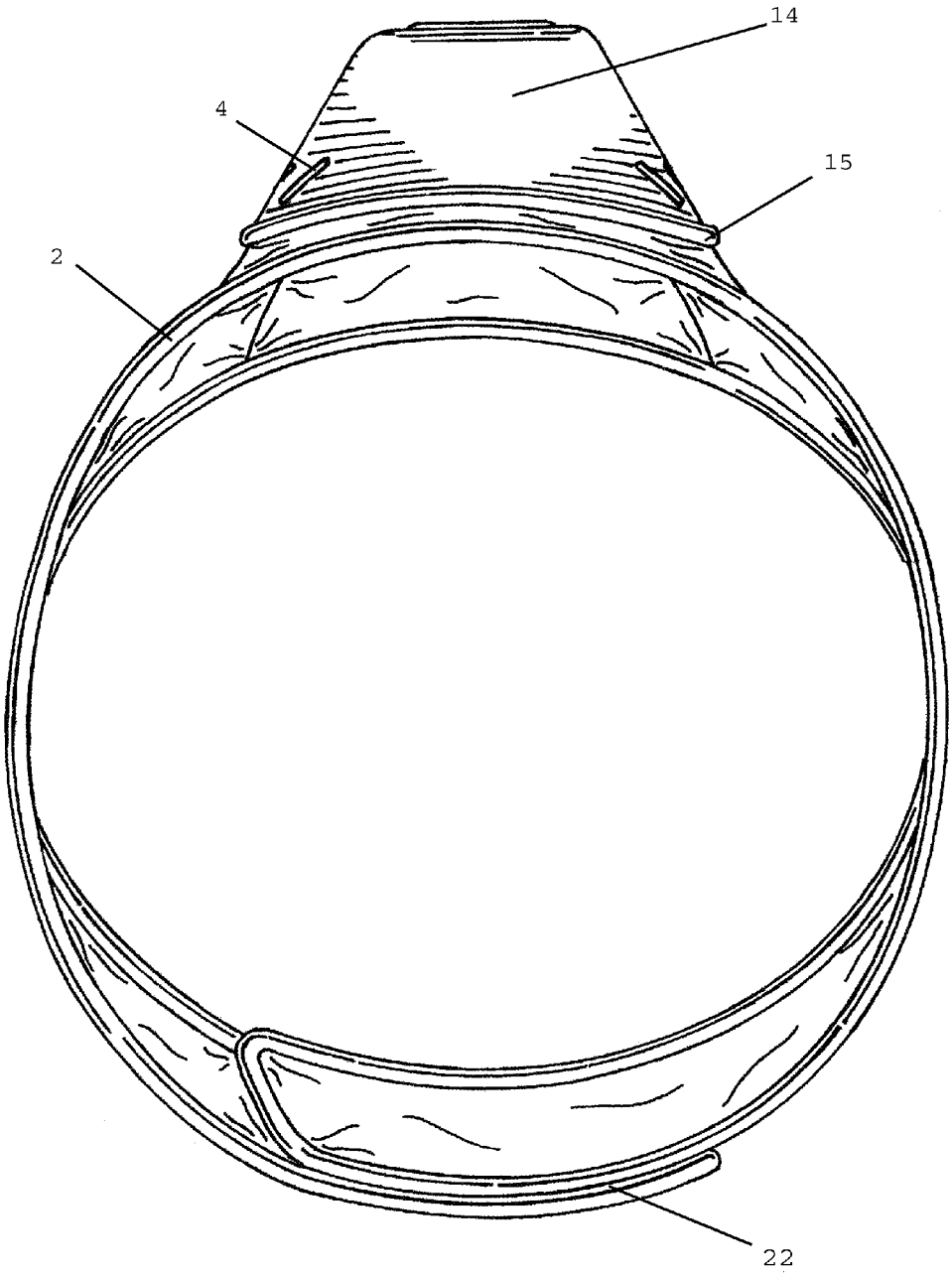
FIG. 20 is a top view of the preferred embodiment of the present invention.
Figure 21:
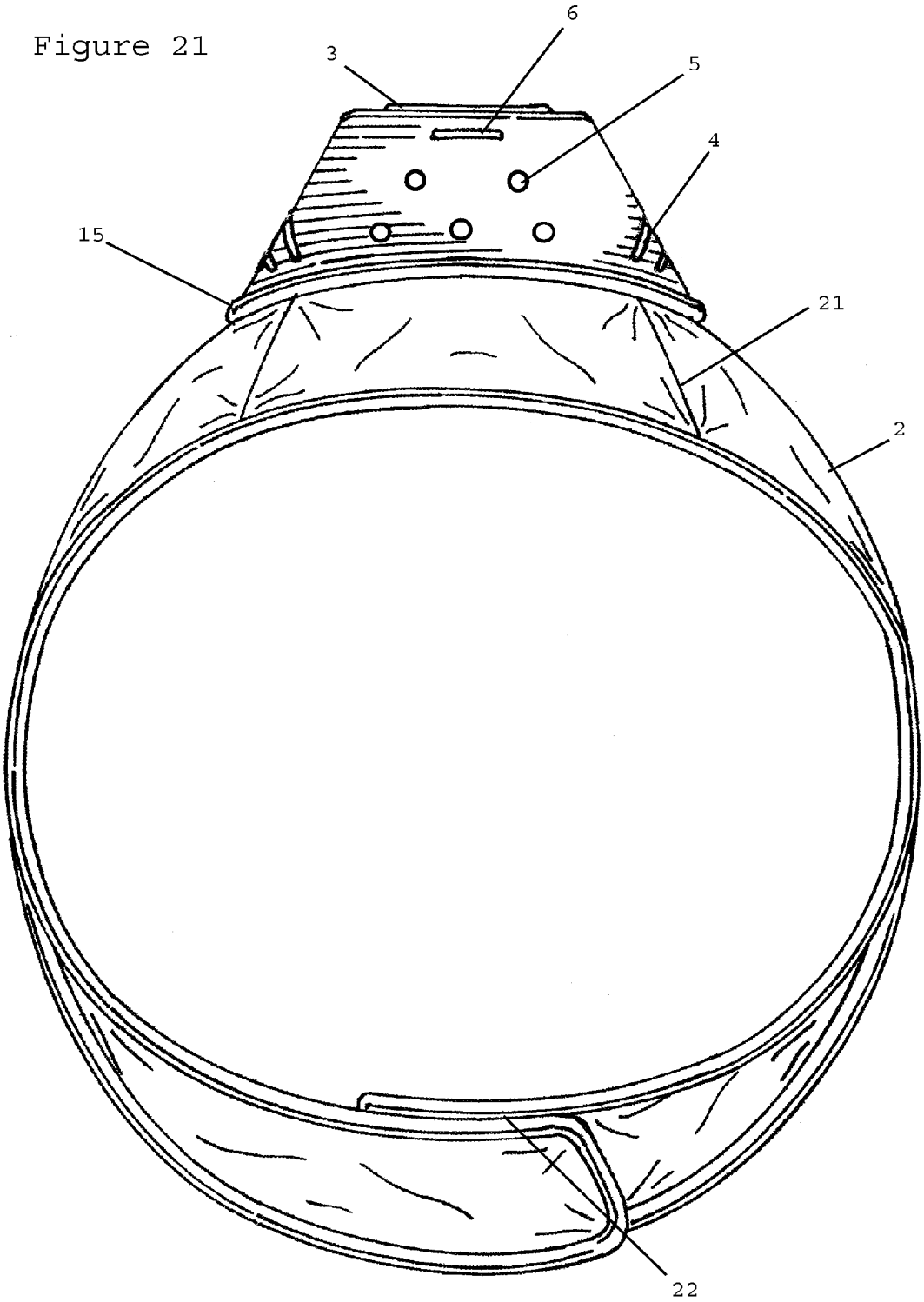
FIG. 21 is a bottom view of the preferred embodiment of the present invention.
Figure 22:
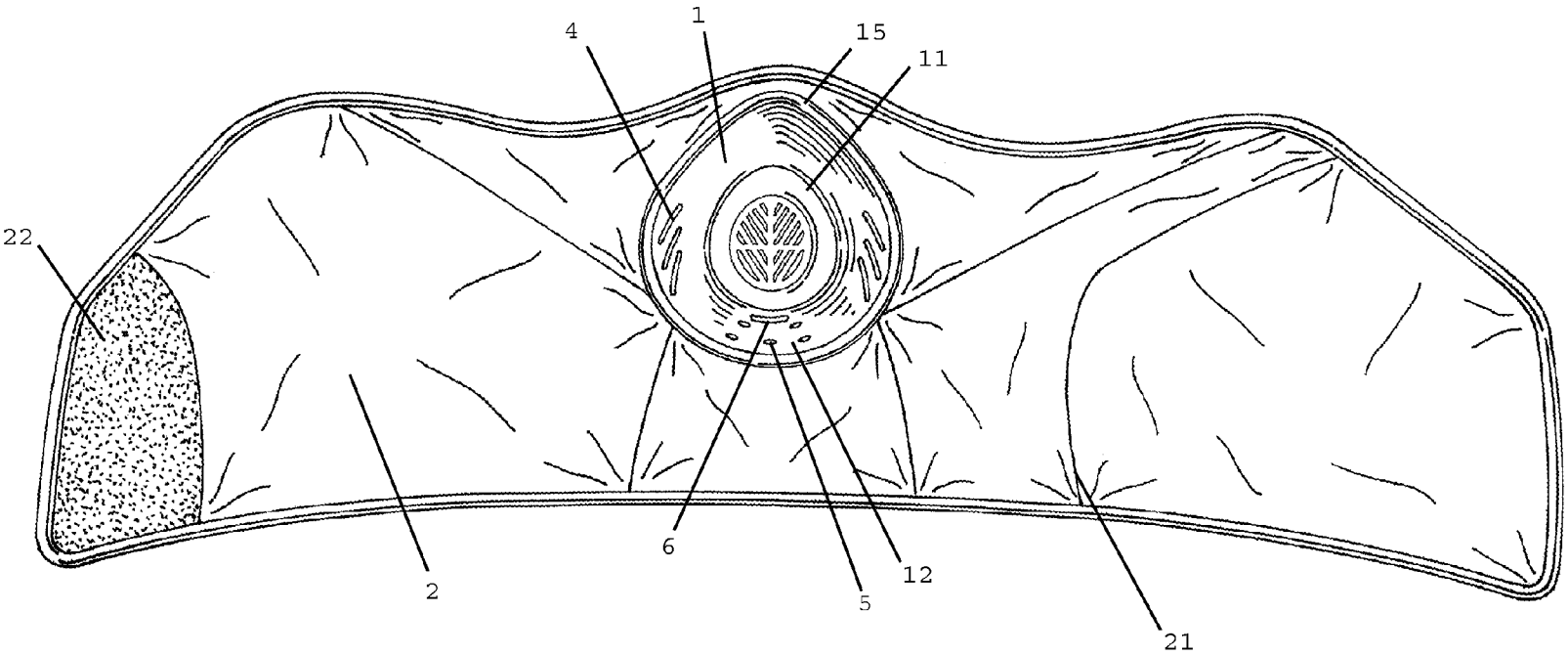
FIG. 22 is a front view of the preferred embodiment of the present invention in a fully detached and laid open position before it is affixed around a head as shown in FIGS. 15-21.
Figure 23:
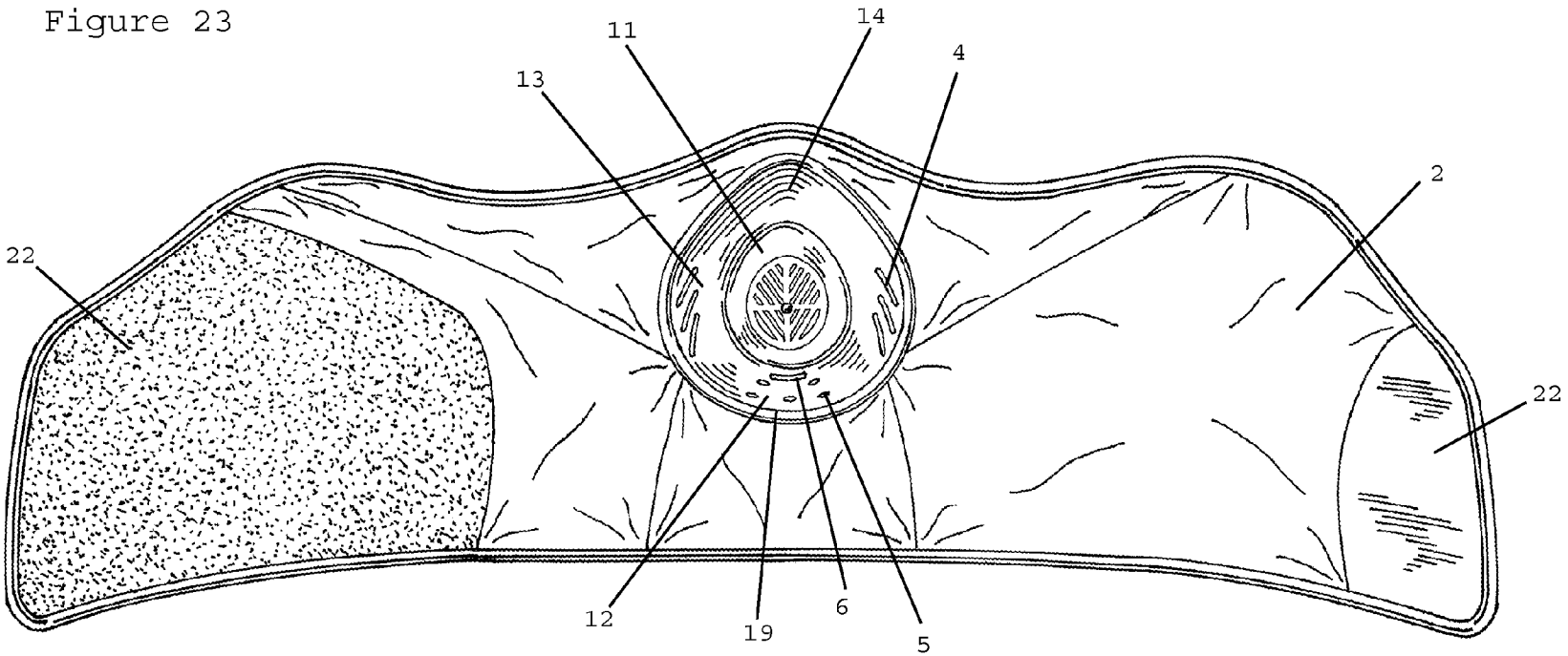
FIG. 23 is a rear view of the preferred embodiment as shown in FIG. 22.

FIG. 8 demonstrates one visual representation of the maximum coverage embodiment of the present invention. The maximum coverage embodiment, couples the same unique chamber 1, fit, and warmth, but utilizes maximum fabric panels 2, which completely or partially cover the wearer's head. For this embodiment, a glasses or goggles opening 23 is provided. The neck 25 and crown 27 may or may not be fully enclosed.

The preferred embodiment of the mask completely covers the ears. FIG. 3 is a front view of the chamber and the minimum coverage embodiment of the present invention and shows the fabric panels 2 accordingly. The ear section is denoted by a circle 9 but in the preferred embodiment, there will be no change in fabric quality or density at this location. According to the preferred embodiment, stretch material desirable to the present invention will provide enough elasticity even when fully covered to allow the comfortable use of earphones, hearing aids, or head phones, without specialized features. Added comfort is experienced by the wearer of these devices because the mask will reduce background noise and wind in the ear. Volume control on such device may be reduced to save ear strain. Possible adaptations of the ear feature 9 for all embodiments may include (1) a special raised formation around the ears; (2) alternate materials covering the ears; (3) circular openings at the ears; or (4) similar design. Workable materials to cover the ears may include fabric, mesh, or free standing headphones or speakers. Such adaptations may increase the ability of the wearer to hear, but may also be advantageous when the wearer wishes to listen to audio devices.

The combination of panels 2 and the chamber 1 must be adjustably secured to a wearer's head. The preferred securing means of the mask to the wearer is currently VELCRO® brand hook and loop fastener strapping 22 affixed to the rear portions of the panels. Other possible means of securing the mask in place may include resistance headband, elastic, spandex, string ties, or lacing. In the preferred embodiment, the VELCRO® brand hook and loop fastener strapping is not visible as it is hidden within the panels. VELCRO® brand hook and loop fastener strapping should be sewn or otherwise affixed to the panels in order to cooperate within the measurement ranges of adult or children head sizes, depending on the model. Embodiments calling for full neck or head coverage may be constructed to slip-on or over the wearer's head.

As can be seen by the preceding disclosure and submitted claims, the present invention meets the needs of outdoor laborers or recreationists in a novel way where the industry has previously failed. The present mask manages moisture, keeps the face warm and dry, prevents fogging of goggles by fitting snugly and comfortably and also giving an alternate exhaust with the use and placement of multiple apertures. In addition, the mask helps humidify cold air drawn in to the mask by the wearer.

Consistent with this disclosure, multiple fabric and pattern variations of the panels 2 and pliable chamber 1 materials are contemplated to meet the aesthetic and functional needs of various wearers, including hunters, skiers, police, or military personnel. The mask is contemplated to be offered in at least two sizing options, one for children and one for adults. Of course, specialized sizing is possible.

Other embodiments and uses of the invention will be apparent to those skilled in the art from consideration of the specification and practice of the invention disclosed herein. As will be easily understood by those of ordinary skill in the art, variations and modifications of each of the disclosed embodiments can be easily made within the scope of this invention as defined herein.

As stated, the preferred mode of manufacture for the present invention is by injection mold and hand or machine sewing. These parameters keep manufacturing costs down. Other materials could also serve the purposes of the present invention. Other manufacturing variations are possible and obvious within the teachings of this disclosure.

It is further intended that any other embodiments of the present invention which result from any changes in application or method of use or operation, method of manufacture, shape, size, or material which are not specified within the detailed written description or illustrations contained herein, yet are considered apparent or obvious to one skilled in the art, are within the scope of the present invention.

COMPONENT LIST FOR COLD OR INCLEMENT WEATHER EXPOSURE MASK

1—chamber
11—front wall
12—lower wall
13—side wall
14—top wall
15 peripheral edge
16—depression
17—post
18—flattened surface
19—lip
2—Fabric panel
21—pleat or dart
22—velcro or fastener
23—goggle opening
24—chin
25—neck
2613 ear
27—crown
28—back of head
29—cheek
3—grate
31—openings
32—parallel bars
33—ovoid ring
34—first bar
35—second bar
36—quadrants
37—center of grate
4—slits
5—circular voids
6—slot
7—control valve
71—ovoid cylindrical structure
72—distal face
73—proximal face
74—interior edge
75—exterior edge
76—cleat
77—hole
78—indicator dots
8—bridge
9—ear circle

What is claimed is:

1. A mask comprising:

a concave-shaped pliable chamber having an interior surface and an exterior surface, each surface constructed to cover a nose and a mouth of a wearer, the chamber further comprising a plurality of bi-directional airflow apertures through the chamber, at least one moisture management aperture through a lower wall of the chamber for discharge of condensation from the chamber, and a moisture retention lip formed along the interior surface of the chamber below the moisture management aperture, the moisture retention lip shaped to collect condensation from the interior surface of the chamber and redirect said condensation toward the moisture management aperture;

at least one panel affixed to the chamber; and means to fasten the panel onto the wearer.

2. A mask of claim 1, wherein the chamber extends generally forward to define a breathing space fluidly connected to an ambient environment by the bi-directional apertures when worn by the wearer.

3. A mask of claim 1, wherein, in addition to the lower wall, the chamber further comprises a front wall, at least two side walls, and a top wall, each with an interior surface and an exterior surface and each adjacent to the front wall.

4. A mask of claim 3, wherein the top wall forms to fit the nose of the wearer.

5. A mask of claim 1, wherein the chamber further comprises a peripheral edge disposed between the interior surface and the exterior surface of the chamber.

6. A mask of claim 5, wherein the peripheral edge is constructed and arranged to rest flush on a wearer's face.

7. A mask of claim 5, wherein a means is provided to affix the panel to the peripheral edge of the chamber.

8. A mask of claim 1, wherein the raised lip is disposed between the apertures and the wearer.

9. A mask of claim 1, wherein the bi-directional apertures further comprise a grate traversing the exterior surface and interior surface of the chamber.

10. A mask of claim 9, the grate further comprising a plurality of bars veering in a downward direction.

11. A mask of claim 9, the grate substantially encircled by an ovoid ring intersected centrally by a first bar and a second bar and further intersected by parallel bars.

12. A mask of claim 1, wherein the at least one moisture management aperture comprises at least one slot.

13. A mask of claim 1, wherein the at least one moisture management aperture comprises at least one void.

14. A mask of claim 1, wherein the bi-directional apertures comprise at least one slit traversing the interior and exterior surfaces of the chamber.

15. A mask according to claim 1, wherein the panel contours to lie at a low-profile against the wearer.

16. A mask of claim 1, wherein the panel comprises a plurality of panels.

17. A mask comprising:

a concave-shaped pliable chamber having an interior surface and an exterior surface, each surface constructed to cover a nose and a mouth of a wearer, the chamber having a plurality of bi-directional airflow apertures through the chamber and a plurality of moisture management apertures through a lower wall of the chamber;

at least one panel affixed to the chamber;

means to fasten the panel onto the wearer;

wherein the chamber further comprises a raised moisture retention lip formed along the interior surface of the chamber below the moisture management apertures, the raised moisture retention lip shaped to collect condensation from the interior surface of the chamber and redirect said condensation toward at least one of the moisture management apertures.

18. A mask comprising:

a concave-shaped pliable chamber extending generally forward to define a breathing space fluidly connected to an ambient environment when worn by a wearer, the chamber arranged and constructed to fit around a mouth and a nose of the wearer, the chamber having a front wall, at least one lower wall, at least two side walls, and at least one top wall, each with an interior surface and an exterior surface, the lower wall, the side walls, and the top wall each adjacent to the front wall, the top wall having a form to fit the nose of the wearer, the lower wall, the side walls, and the top wall of the chamber having a peripheral edge disposed opposite the front wall, the peripheral edge arranged to rest flush on a wearer's face, the chamber further comprising a plurality of bi-directional airflow apertures, the apertures comprising at least one grate, and the apertures further comprising a moisture management system having at least one slot, and at least one void, the apertures further comprising at least one slit located on each side wall, the grate disposed on the chamber front wall, the slot disposed on the lower wall of the chamber at a distance away from the face, the void disposed on the lower wall of the chamber between the slot and the wearer's face, the slits disposed on the side wall of the chamber, the chamber further comprising a raised lip disposed between the apertures and the wearer and below the moisture management system, at least one panel affixed to the peripheral edge of the chamber, the panel providing a means to fasten or hold the mask securely in place on the wearer.

19. A mask according to claim 18, the grate further comprising an ovoid ring intersected by a first bar and a second bar and traversed by parallel bars each veering and angled in a slight downward direction.

20. A mask comprising:

a concave-shaped, pliable chamber extending generally forward to define a breathing space fluidly connected to an ambient environment when worn by a wearer, the chamber arranged and constructed to fit around a mouth and nose of the wearer, the chamber having a front wall, at least one lower wall, at least two side walls, and at least one top wall, each with an interior surface and an exterior surface, the lower wall, the side walls, and the top wall each adjacent to the front wall, the top wall having a form to fit the nose of the wearer, the lower wall, the side walls, and the top wall of the chamber having a peripheral edge disposed opposite the front wall, the peripheral edge arranged to rest flush on a wearer's face, the chamber further comprising a plurality of bi-directional air flow apertures, the apertures comprising at least one grate, and the apertures further comprising a moisture management system having at least one slot, and at least one void, the apertures further comprising at least one slit located on each side wall, the grate disposed on the chamber front wall, the slot disposed on the lower wall of the chamber at a distance away from the face and nearer the front wall, the void disposed on the lower wall of the chamber between the slot and the wearer's face, the slits disposed on the side wall of the chamber, the chamber further comprising a raised lip disposed between the apertures and the wearer and below the moisture management system, at least one panel affixed to the peripheral edge of the chamber, the panel providing a means to fasten or hold the mask in place on the wearer.

21. A mask comprising:

a concave-shaped pliable chamber extending generally forward to define a breathing space fluidly connected to an ambient environment when worn by a wearer, the chamber arranged and constructed to fit around a mouth and a nose of the wearer, the chamber having a front wall, at least one lower wall, at least two side walls, and at least one top wall, each with an interior surface and an exterior surface, the lower wall, the side walls, and the top wall each adjacent to the front wall, the top wall having a form to fit the nose of the wearer, the lower wall, the side walls, and the top wall of the chamber having a peripheral edge disposed opposite the front wall, the peripheral edge arranged to rest flush on a wearer's face, the chamber further comprising a plurality of bi-directional airflow apertures, the apertures comprising at least one grate, and further comprising a series of moisture management apertures through the chamber, the moisture management apertures comprising at least one slot for venting of air and moisture from the chamber, at least one void below the slot for draining condensation from the interior surface of the chamber, and at least one slit through each side wall of the chamber, the grate disposed on the chamber front wall, the slot disposed on the lower wall of the chamber at a distance away from the face and nearer the front wall, the void disposed on the lower wall of the chamber between the slot and the wearer's face, the interior surface of the chamber further comprising a raised lip below at least one of the moisture management apertures, the raised lip shaped to direct moisture from the interior surface to the moisture management aperture for drainage from the chamber, at least one panel affixed to the peripheral edge of the chamber, the panel providing a means to fasten or hold the mask securely in place on the wearer.

22. A mask comprising:

a concave-shaped, pliable chamber extending generally forward to define a breathing space fluidly connected to an ambient environment when worn by a wearer, the chamber arranged and constructed to fit around a mouth and nose of the wearer, the chamber having a front wall, at least one lower wall, at least two side walls, and at least one top wall, each with an interior surface and an exterior surface, the lower wall, the side walls, and the top wall each adjacent to the front wall, the top wall having a form to fit the nose of the wearer, the lower wall, the side walls, and the top wall of the chamber having a peripheral edge disposed opposite the front wall, the peripheral edge arranged to rest flush on a wearer's face, the chamber further comprising a plurality of bi-directional air flow apertures, the apertures comprising at least one grate, and further comprising a series of moisture management apertures through the chamber, the moisture management apertures comprising at least one slot for venting air and moisture from the chamber, at least one void for draining condensation from the interior surface of the chamber, and at least one slit through each side wall, the grate disposed on the chamber front wall, the slot disposed on the lower wall of the chamber at a distance away from the face and nearer the front wall, the void disposed on the lower wall of the chamber between the slot and the wearer's face, the chamber further comprising a raised lip below at least one of the moisture management apertures, the raised lip shaped to direct moisture from the interior surface to the moisture management aperture for drainage from the chamber, at least one panel affixed to the peripheral edge of the chamber, the panel providing a means to fasten or hold the mask in place on the wearer.

* * * * *